US005648808A

United States Patent [19]

Yanagi et al.

[11] Patent Number: 5,648,808

[45] Date of Patent: Jul. 15, 1997

[54] AUTOMATIC SHEET FEEDING APPARATUS

[75] Inventors: Haruyuki Yanagi, Yokohama; Shinnosuke Taniishi, Kawasaki; Tetsuo Suzuki, Yokohama; Junichi Asano, Kawasaki; Soichi Hiramatsu, Yokohama; Takashi Nojima, Tokyo; Satoshi Saikawa, Inagi, all of Japan

[73] Assignee: Canon Kabushiki Kaisha, Tokyo, Japan

[21] Appl. No.: 894,997

[22] Filed: Jun. 8, 1992

[30] Foreign Application Priority Data

| | | | |
|---|---|---|---|
| Jun. 10, 1991 | [JP] | Japan | 3-137837 |
| Jun. 10, 1991 | [JP] | Japan | 3-137838 |
| Jul. 26, 1991 | [JP] | Japan | 3-187656 |

[51] Int. Cl.[6] ..... B41J 2/01

[52] U.S. Cl. ..... 347/104; 271/114; 271/116; 271/229; 271/245; 400/579

[58] Field of Search ..... 346/134, 138, 346/140 R; 400/579, 624; 271/114, 116, 119, 121, 170, 229, 242, 245; 347/104

[56] References Cited

U.S. PATENT DOCUMENTS

| | | | |
|---|---|---|---|
| 3,640,524 | 2/1972 | Fredrickson | 271/36 |
| 4,372,547 | 2/1983 | Yamagawa et al. . | |
| 4,618,134 | 10/1986 | Kawaguchi et al. | 271/4 |
| 4,685,793 | 8/1987 | Sawada et al. | 271/253 |
| 5,026,042 | 6/1991 | Miller | 271/119 |
| 5,092,579 | 3/1992 | Tokoro et al. | 271/240 |
| 5,120,040 | 6/1992 | Worley | 271/119 |
| 5,171,006 | 12/1992 | Naito | 271/242 |

FOREIGN PATENT DOCUMENTS

| | | |
|---|---|---|
| 0386737 | 9/1990 | European Pat. Off. . |
| 2445284 | 7/1980 | France . |
| 54-095471 | 7/1979 | Japan . |
| 54-107070 | 8/1979 | Japan . |
| 56-165640 | 12/1981 | Japan . |
| 59-064429 | 4/1984 | Japan . |

*Primary Examiner*—John E. Barlow, Jr.

*Attorney, Agent, or Firm*—Fitzpatrick, Cella, Harper & Scinto

[57] ABSTRACT

An automatic sheet feeding apparatus includes a sheet supporter for supporting sheets, a sheet supplier for feeding out the sheet from the sheet supporter, a separator for separating the sheets one by one at the feeding of the sheet by the sheet supplier, by regulating one of front corners of the sheets supported by the sheet supporting means in a sheet feeding direction, and a skew-feed corrector for correcting the skew-feed of the sheet by applying a resisting force to the sheet fed by the sheet supplier.

25 Claims, 20 Drawing Sheets

AUTOMATIC SHEET FEEDING APPARATUS

BACKGROUND OF THE INVENTION

1. Field of the Invention

The present invention relates to an automatic sheet feeding apparatus for automatically feeding sheets one by one.

2. Related Background Art

Recording systems such as printers, copying machines, facsimiles and the like have been designed so that an image comprised of a dot pattern was formed on a recording sheet such as paper, plastic film and the like by driving energy generating means of a recording head in response to image information. Such recording systems can be grouped into ink dot recording type, wire dot recording type, thermal type, electro-photographic type and the like in accordance with the recording modes. On the other hand, recording sheets used with the recording systems may include a thicker sheet such as a post card, an envelope or the like, and a special sheet such as a plastic film or the like, as well as a plain paper sheet. The recording sheets have been supplied one by one in a manual supply mode, or sequentially in an automatic supply mode by automatic sheet feeding apparatuses.

FIG. 36 is a perspective view of a conventional recording system B on which an automatic sheet feeding apparatus A is mounted, and FIG. 37 is a perspective view showing the construction of the conventional automatic sheet feeding apparatus A. As shown in FIGS. 36 and 37, the automatic sheet feeding apparatus A generally includes a sheet supply drive portion comprising left and right sheet supply rollers 101, 102, a sheet supply shaft 106 and a drive gear 107, and a sheet supply cassette portion stacking sheets and comprising left and right side guides 103, 104 and a pressure plate 105, and is so designed that the sheets are separated one by one by means of left and right separating claws or pawls 109, 110 and of the sheet supply rollers 101, 102 driven by a driving force from a sheet feeding mechanism of the recording system via the drive gear 107 and supplied to guide member 111. A release lever 108 is also provided to control a pressure force applied to the stack of sheets.

However, the above-mentioned conventional sheet feeding apparatus has the following drawbacks, since the sheet separating means such as the sheet supply rollers 101, 102 and the separating claws 109, 110 are disposed in pairs at the left and right:

(1) The construction becomes complicated, and the number of parts is increased, thus making the apparatus expensive; and (2) Since a space through which the sheet supply shaft 106 passes must be reserved, the apparatus becomes large-sized.

To eliminate these drawbacks, the technique in which a separating claw and a sheet supply roller are arranged only at one side of the apparatus has been proposed, as disclosed in U.S. Pat. No. 4,372,547. In this case, however, since the sheet is skew-fed, a skew-feed preventing roller must be additionally provided (see the above U.S. Pat. No. 4,372,547). Accordingly, even with this technique, the cost of the apparatus cannot be reduced satisfactorily.

SUMMARY OF THE INVENTION

The present invention provides an automatic sheet feeding apparatus comprising sheet supporting means for supporting sheets, sheet supply means for feeding out the sheet from the sheet supporting means, separation means for separating the sheets one by one at the feeding of the sheet by means of the sheet supply means, by regulating one of front corners of the sheets supported by the sheet supporting means in a sheet feeding direction, and skew-feed correction means for correcting the skew-feed of the sheet by applying a resisting force to the sheet fed by the sheet supply means.

Preferably, the separating means comprises a separating claw and the sheet supply means comprises a roller rotatingly driven.

According to an embodiment of the skew-feed correction means, it comprises an abutment surface against which a leading end of the fed sheet is abutted and which applies a resisting force to the sheet. The abutment surface is preferably curved so that the resisting force is applied to the sheet when the latter is slidingly contacted with the curved surface. Further, rubber sheets may be attached to or indentations may be formed on local positions corresponding to the sizes of the sheets to locally increase the coefficient of friction at those positions, thereby increasing the resisting forces at those positions.

In this way, by applying the resisting force to the sheet separated and fed out, with the simple construction such as the abutment surface and the like, it is possible to correct the skew-feed of the sheet.

Further, the present invention provides an automatic sheet feeding apparatus comprising sheet supporting means for supporting sheets, sheet supply means arranged at a position offset from a centerline of the sheet and adapted to feed out the sheet from the sheet supporting means, separation means for separating the sheets one by one at the feeding of the sheet by means of the sheet supply means, by regulating one of front corners of the sheets supported by the sheet supporting means in a sheet feeding direction, the front corner being situated at the same side as the offset position, and guide means for correcting the skew-feed of the sheet by suppressing the deformation of the sheet fed out by the sheet supply means.

Also in this case, preferably, the separating means comprises a separating claw and the sheet supply means comprises a roller rotatingly driven.

According to an embodiment of the guide means, it comprises an upper guide member and a lower guide member, and is so designed that a portion of the upper guide member opposite to (i.e., remote from) the separation means in the sheet feeding direction is partially protruded toward the lower guide member or a portion of the lower guide member near the separation means is partially protruded toward the upper guide member. In this way, by partially protruding the guide member toward a position where the sheet is flexed, so that the flexion of the sheet is suppressed, it is possible to prevent the skew-feed of the sheet.

According to another embodiment of the guide means, it comprises an upper guide member and a lower guide member, and is so designed that the upper guide member has a plurality of rollers and the roller farthest from the separation means in a widthwise direction of the sheet is protruded toward the lower guide member, or the lower guide member has a plurality of rollers and the roller nearest to the separation means is protruded toward the upper guide member. In this way, by partially protruding the guide member toward a position where the sheet is flexed, so that the flexion of the sheet is suppressed, it is possible to prevent the skew-feed of the sheet.

DETAILED DESCRIPTION OF THE PREFERRED EMBODIMENTS

Figure 1:
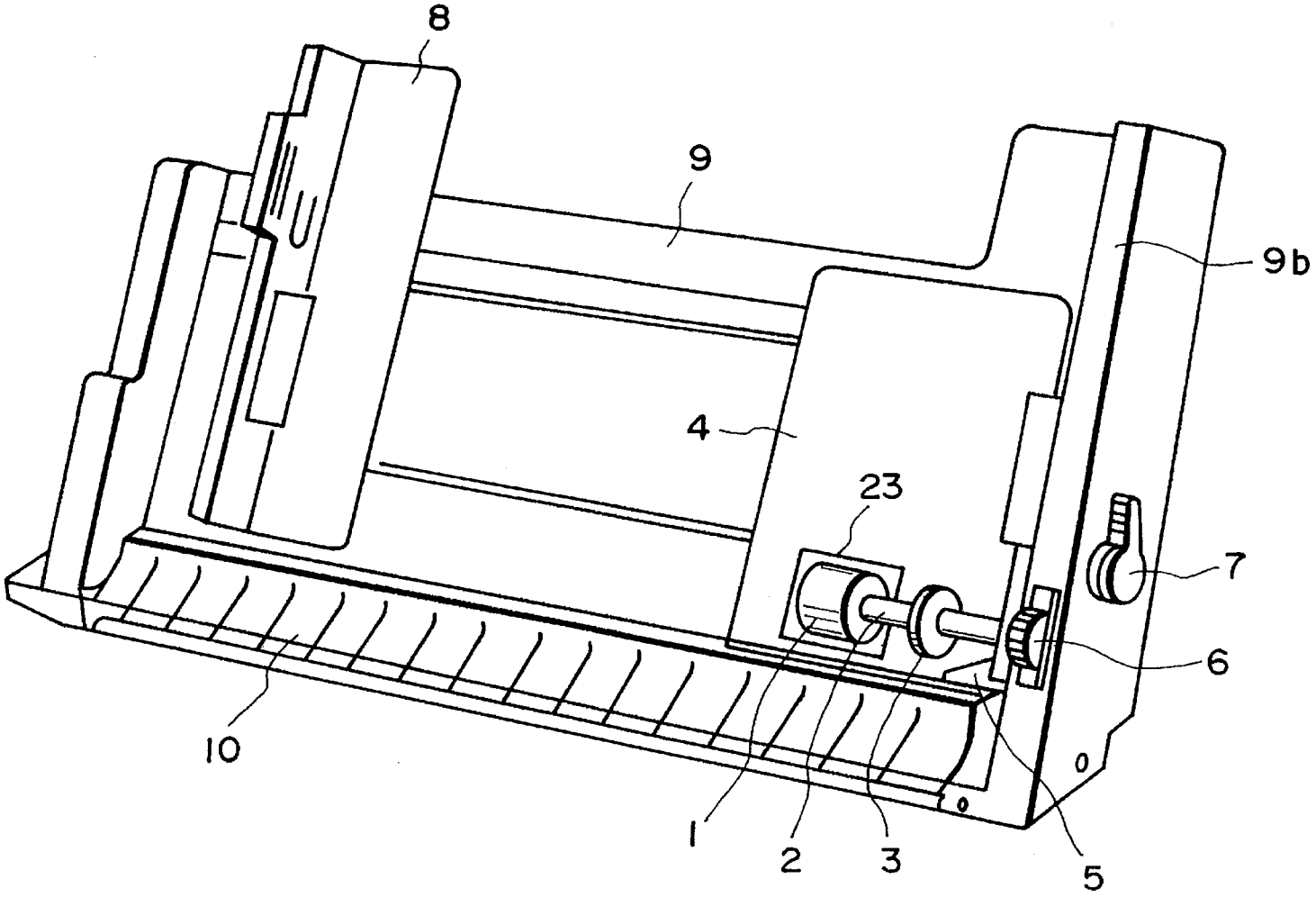
FIG. 1 is a perspective view of an automatic sheet feeding apparatus according to a first embodiment of the present invention.
Figure 2:
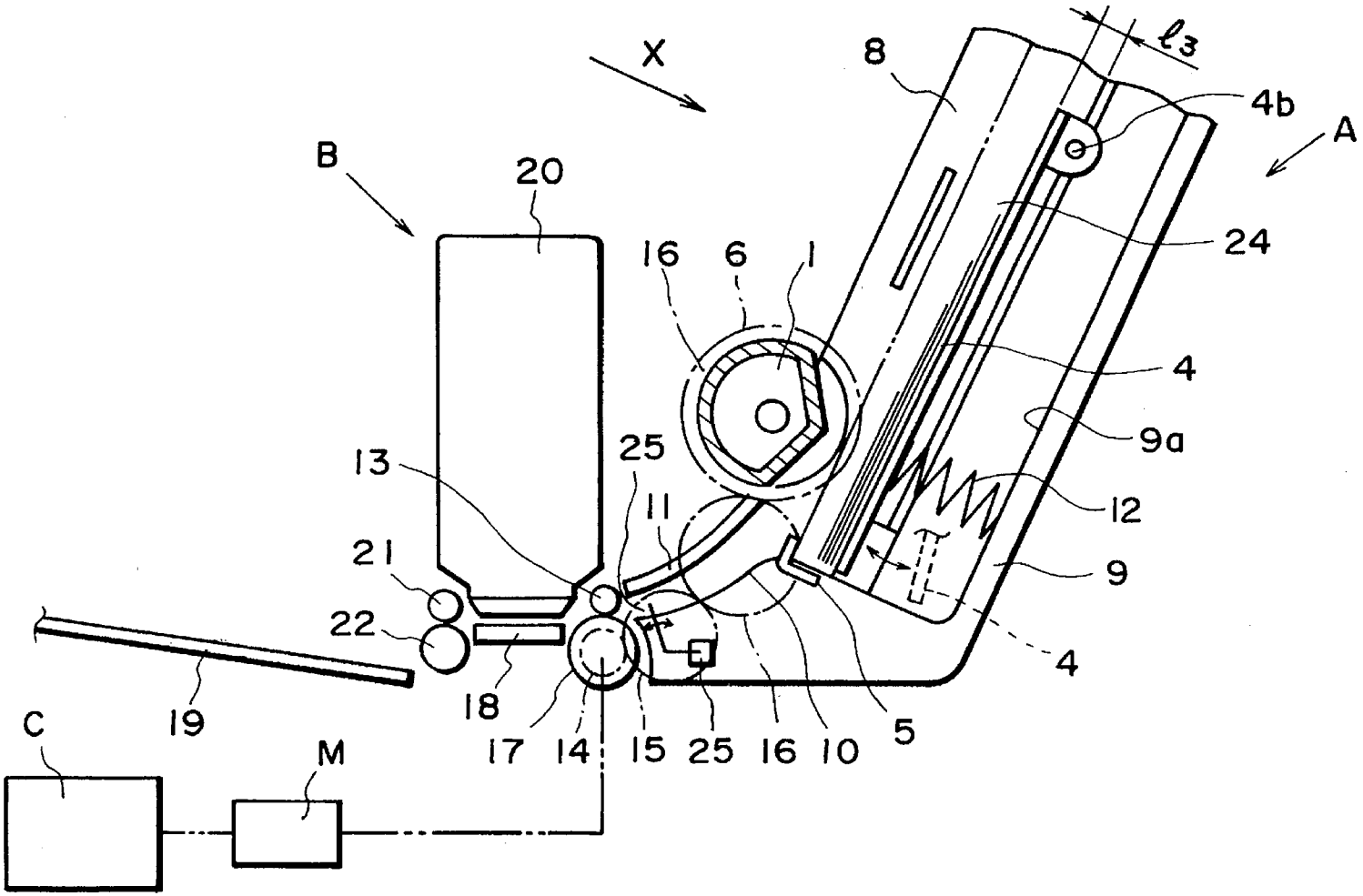
FIG. 2 is a sectional view of a recording system on which the automatic sheet feeding apparatus of FIG. 1 is mounted.
Figure 3:
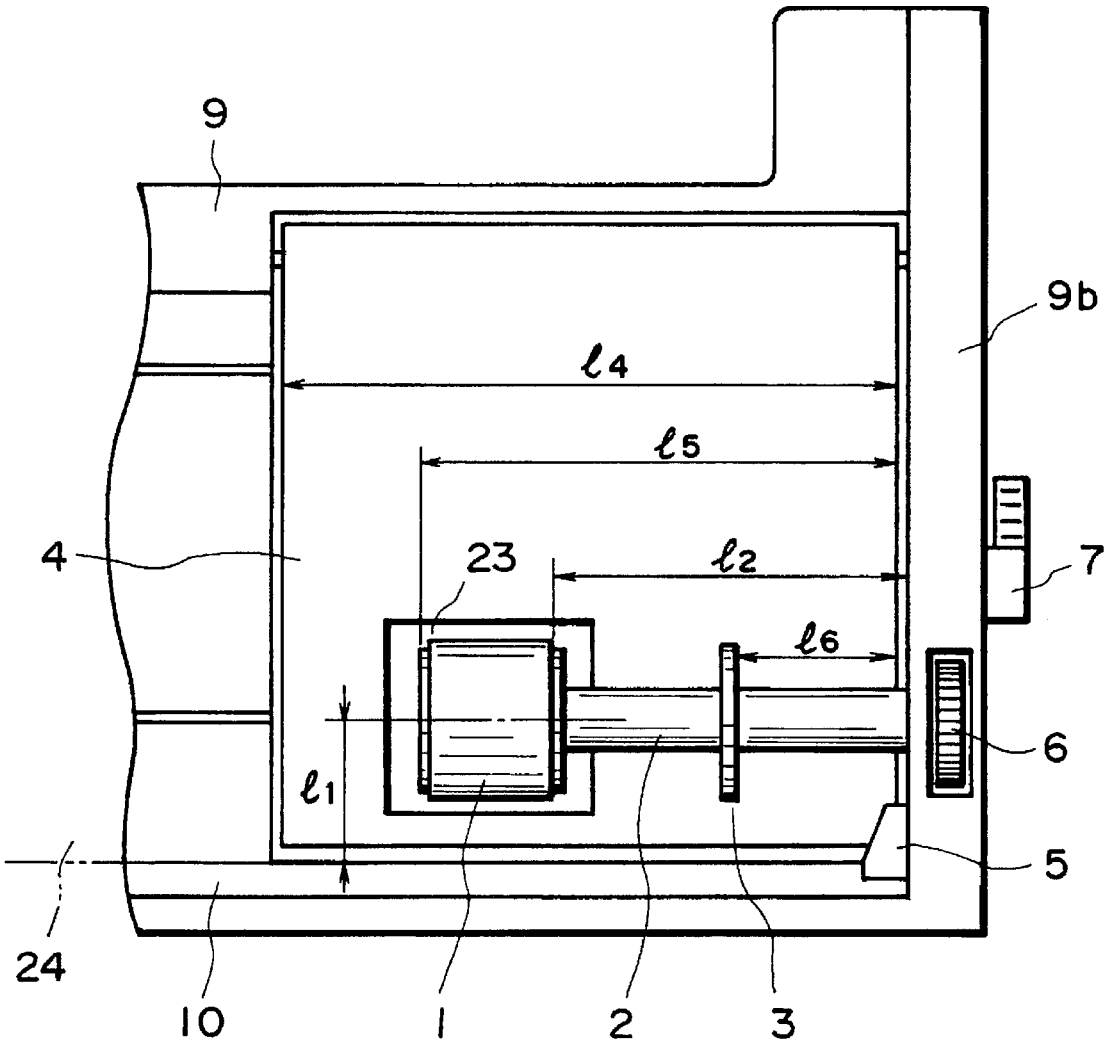
FIG. 3 is a view looked at from a direction shown by the arrow X in FIG. 2.

As shown in FIGS. 1 to 3, an automatic sheet feeding apparatus is constituted by a sheet supply drive portion comprising a sheet supply roller 1, a sheet supply roller shaft 2, an auxiliary roller 3, a separating pawl or claw 5, a drive gear 6 and the like, and a sheet supply cassette portion comprising a pressure plate 4, a release lever 7, a movable side guide 8, a base 9 and the like.

First of all, the schematic construction and operation of these elements will be described. When the release lever 7 is released, a pressure plate spring 12 is compressed to rotate the pressure plate 4 around a pressure plate shaft 4*b*, thereby separating the pressure plate from the sheet supply roller 1, as shown by a broken line. In this condition, leading ends of sheets 24 are abutted against an abutment portion disposed at an upstream side of a lower guide portion 10, thereby aligning the leading ends of the sheets with each other. Further, the movable side guide 8 is shifted so that left edges of the sheets are abutted against a fixed side guide portion 9*b* situated at the left side regarding a sheet feeding direction. In this way, the sheets are set. In this condition, when the release lever 7 is returned to its original position, the pressure plate 4 is also returned by the pressure plate spring 12, so that the sheets 24 are urged against the sheet supply roller 1. In this way, the setting of the sheets 24 is completed.

In the condition that the sheets 24 has been set, a driving force of a feed roller 17 is transmitted to the sheet supply roller 1 via a four-state gear train comprising a gear 14, a gear 15, a gear 16 and the drive gear 6. The sheets 24 picked up by the sheet supply roller 1 are separated one by one by the separating claw 5, and the separated sheet is passed between a lower guide 11 and the lower guide portion 10 to reach a nip between a pinch roller 13 and the feed roller 17 which are being rotated. A sheet sensor 25 disposed in front of the paired rollers 13, 17 detects the leading end of the sheet 24, thus determining a printing position on the sheet 24. The sheet 24 fed by the paired rollers 13, 17 is brought on a platen 18 of a recording system B, and an image corresponding to predetermined image information is recorded on the sheet 24 by a recording head 20 while the sheet is being moved along the platen. The recording head 20 is formed integrally with an ink tank to provide an easily exchangeable ink jet recording head. The recording head 20 is provided with electrical/thermal converters to which thermal energy is selectively applied, so that ink is selectively discharged from discharge opening(s) of the recording head by utilizing the change in pressure due to the growth and contraction of bubble(s) in response to the nucleate boiling, thus performing the recording.

The sheet 24 on which the predetermined image was formed is ejected onto an ejection tray 19 by spurs 21 and an ejector roller 22 without damaging the image formed on the sheet 24. Incidentally, the rotation of a motor M (FIG. 2) for driving the feed roller 17 is controlled by a control device C of the recording system B.

Next, the main elements of the above-mentioned automatic sheet feeding apparatus will be fully explained.

The above-mentioned fixed side guide portion 9*b*, lower guide portion 10 and movable side guide 8 are arranged on the base 9. By shifting the movable side guide 8, the position of the sheets 24 is regulated with respect to the fixed side guide 9*b* and the abutment portion disposed at the upstream side of the lower guide portion 10, thus setting the sheets. Further, the base 9 is provided with a recess 9*a* within which the pressure plate 4 can be retarded and within which the pressure plate spring 12 is arranged in confronting relation to the sheet supply roller 1. The pressure plate 4 is pivotally mounted, at its upper end, on the base 9 via the pressure plate shaft 4*b* for pivotal movement around the pressure plate shaft 4*b*. Normally, in the condition that the sheets are set, the pressure plate 4 is urged (with the interposition of the sheets) against the sheet supply roller 1 by the pressure plate spring 12. When the sheets are exchanged or new sheets are set, the pressure plate 4 can be retarded to the position shown by the broken line (FIG. 2) by releasing the release lever 7.

Although the position of the pressure plate 4 varies in accordance with a thickness of the sheet stack 24 when the sheets are set, a hight difference $l_3$ (FIG. 2) between the pressure plate 4 and a lower end of the movable side guide 8 or a fixed portion of the base 9 is selected to have a value of 0–10 mm so that the pressure plate 4 is always higher than or equal to the lower end of the movable side guide. By providing such height difference, it is possible to reduce the load to the sheets, to improve the relation between the sheet supply roller 1 and the sheets 24 and to feed the sheet smoothly with less skew-feed.

Further, a width $l_4$ (FIG. 3) of the pressure plate 4 has a predetermined value greater than a distance $l_5$ (FIG. 3) between base and free ends of the sheet supply roller 1 and smaller than a width of the minimum sized sheet.

Figure 4:
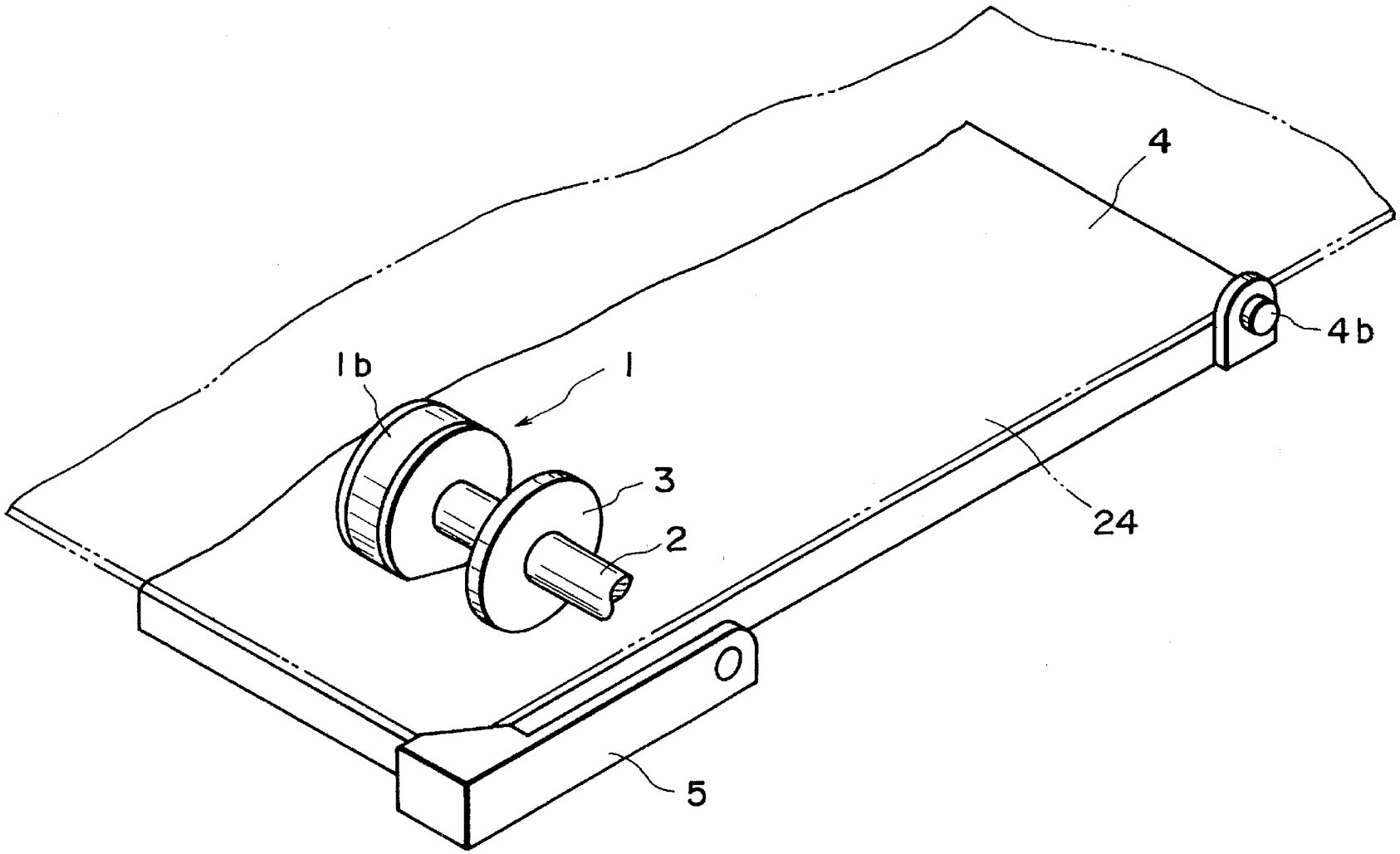
FIG. 4 is a perspective view of a sheet supply roller of the automatic sheet feeding apparatus of FIG. 1.

Further, a separating pad 23 made of material having relatively higher coefficient of friction (such as artificial leather) is provided on the pressure plate 4 at a position confronting to the sheet supply roller 1, thereby preventing the double-feed of the sheets when the number of sheets is decreased. As shown in FIG. 4, the sheet supply roller 1, sheet supply roller shaft 2 and auxiliary roller 3 are integrally formed with each other, and the drive gear 6 is connected to the sheet supply roller shaft 3. The driving force of the feed roller 17 is transmitted to the sheet supply roller shaft via the gears 14–16 and the drive gear 6. The sheet supply roller 1 is a D-shaped cylindrical (or semi-cylindrical) roller and is provided at its periphery with a rubber layer 1*b*. During one revolution of the sheet supply roller 1, an uppermost sheet is separated from the sheet stack 24 by the separating claw 5 and is passed between the upper guide 11 and the lower guide portion 10 to reach the nip between the pinch roller 13 and the feed roller 17 which are being rotated. In this case, the heading of the sheet 24 is effected by detecting the leading end of the sheet 24 by means of the sheet sensor 25. Further, the sheet supply roller 3 is connected to the drive gear 6 via a one-revolution clutch (not shown) so that the sheet supply roller shaft is stopped at a predetermined position after one revolution, with the result that the separated sheet can be moved through a space between the rubber layer 1*b* of the sheet supply roller and the sheet stack 24. When the sheet is supplied again, the feed roller 17 is slightly rotated in a reverse direction to switch it in a rotatable condition by the clutch trigger of the one-revolution clutch. A width of the sheet supply roller 1 is about 20 mm, a distance $l_1$ (FIG. 3) between the abutment portion upstream of the lower guide portion 10 and a centerline of the sheet supply roller 1 is 20–30 mm, and a distance $l_2$ between the fixed side guide and the sheet supply roller 1 is about 40–60 mm in case of a sheet having A4 longitudinal size. Regarding the position of the sheet supply roller 1, if the distance $l_1$ is too small or too great, the associating relation between the sheet supply roller 1 and the lower guide portion 10 and the separating claw 5 is worsened, thus easily causing the scratching of the sheet, double-feed of the sheets and/or the sheet jam. Accordingly, the distance $l_1$ may be properly selected within a range of 5–50 mm.

Further, although the distance $l_2$ is desirable to be selected so that the sheet supply roller 1 is positioned near the centerline of the sheet 24 as long as possible in consideration of the balancing of the sheet supply to avoid the skew-feed of the sheet, the distance $l_2$ may be properly selected within a range of 20 mm—half of maximum sheet width.

As mentioned above, the sheet supply roller 1 is spaced apart from the separating claw by a greater distance than that of the conventional case, with the result that the scratching of the sheet, double-feed of the sheets and/or the sheet jam can easily occur. To avoid this, as shown in FIG. 4, the auxiliary roller 3 having substantially the same diameter as that of the cylindrical portion of the sheet supply roller 1 is arranged at a position defined by distances $l_1$=20–30 mm and $l_6$=20 mm, for example, and nearer to the separating claw, thereby preventing the occurrence of the above-mentioned scratching, double-feed and sheet jam. In this regard, when the sheet is separated by riding over the separating claw 5, a loop is formed in the leading end portion of the sheet 24. If the loop is too great, the skew-feed of the sheet will easily occur. Accordingly, by regulating the extent of the loop by means of the auxiliary roller 3, it is possible to prevent the skew-feed of the sheet.

Now, another example of the regulating means similar to the auxiliary roller 3 will be described.

Figure 5:
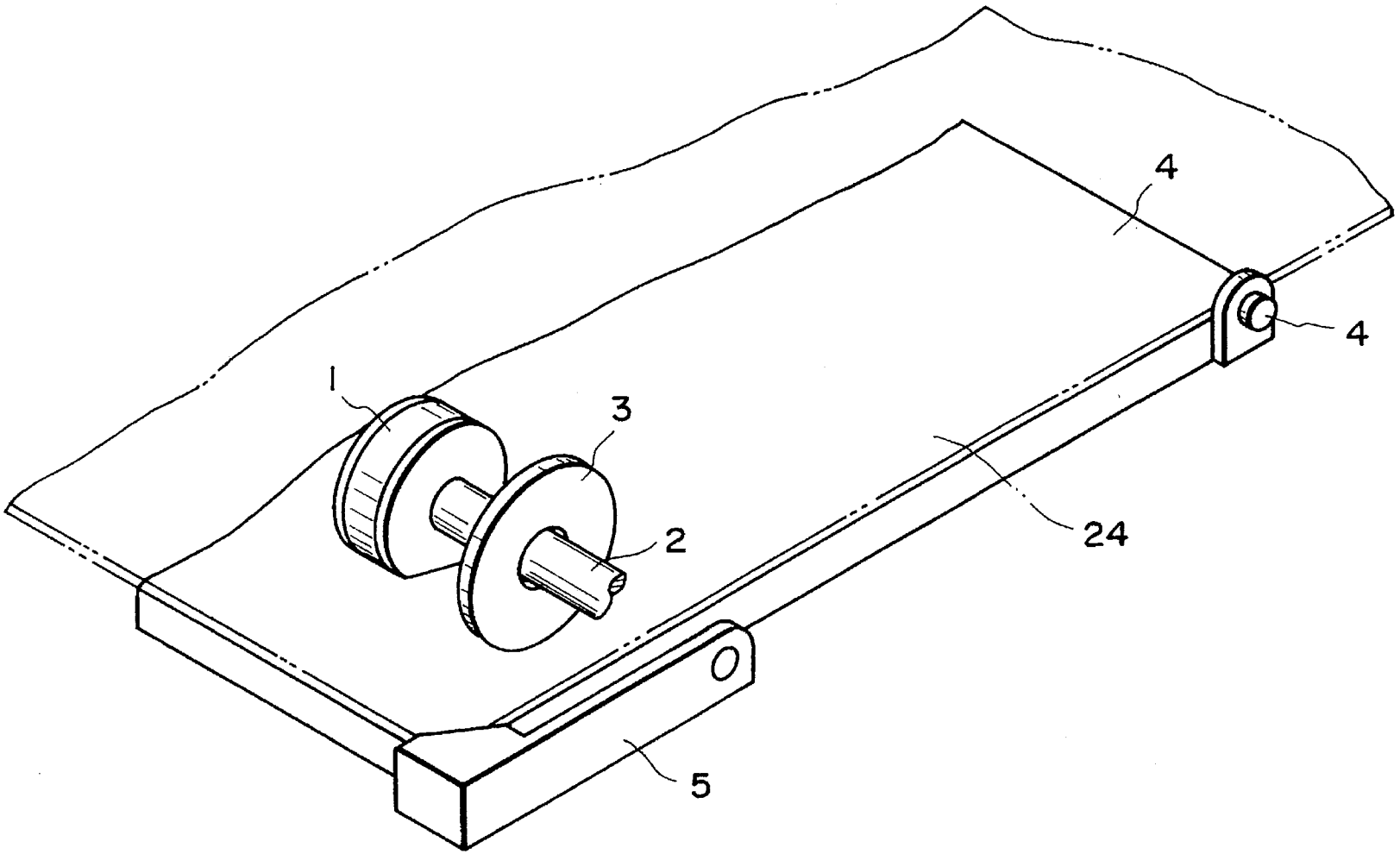
FIG. 5 is a perspective view of regulating means for preventing the floating of a recording sheet, according to another embodiment.
Figure 6:
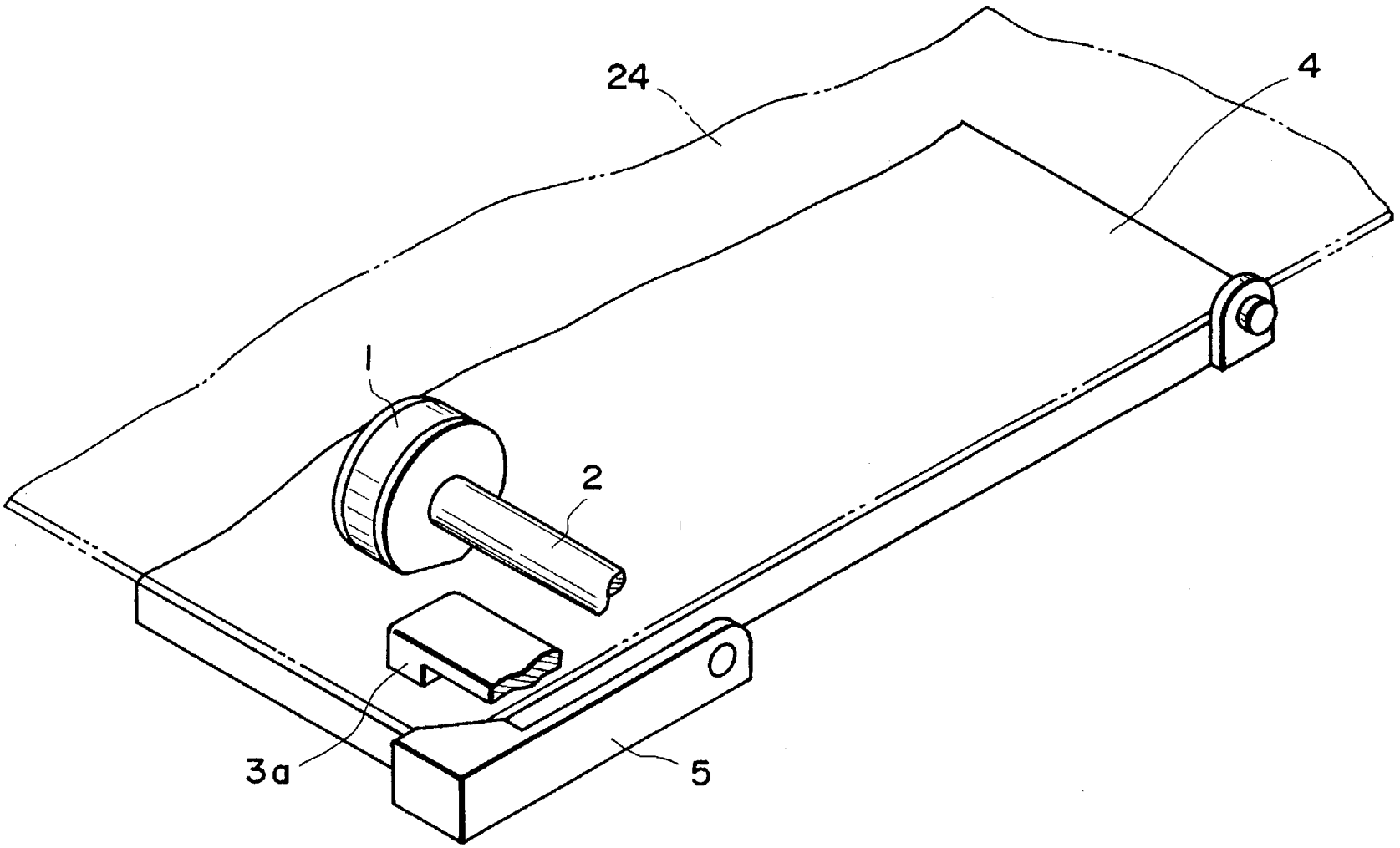
FIG. 6 is a perspective view of regulating means for preventing the floating of a recording sheet, according to a further embodiment.

In FIG. 5, an auxiliary roller 3 is rotatably mounted on the sheet supply roller shaft 2, and a small gap is provided between the auxiliary roller and the sheet supply roller shaft so that the auxiliary roller 3 is urged against the sheet stack 24 by its own weight or via the sheet supply roller shaft 2. With this arrangement, when the uppermost sheet 24 is separated from the sheet stack by means of the separating claw 5, the uppermost sheet is contacted with the auxiliary roller 3 with less resisting force, thus providing better sheet supply to further prevent the above-mentioned scratching, double-feed and sheet jam. Alternatively, as shown in FIG. 6, in place of the auxiliary roller, a sheet hold-down arm 3*a* having a non-cylindrical configuration may be provided independently from the sheet supply roller shaft 2. The sheet hold-down arm 3*a* is supported by the fixed side guide 9*b* and the like to have proper elasticity, and is urged against the sheet stack 24 or is slightly spaced apart from the sheet stack.

With this arrangement, it is possible to arrange the regulating means for the sheet 24 nearer to the separating claw 5, thus preventing the skew-feed of the sheet more effectively.

Figure 7:
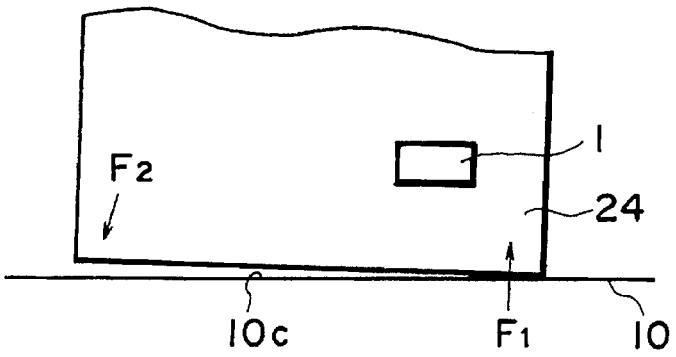
FIG. 7 is an explanatory view for explaining an example that the skew-feed of the sheet is corrected by an abutment surface of guide means.
Figure 8:
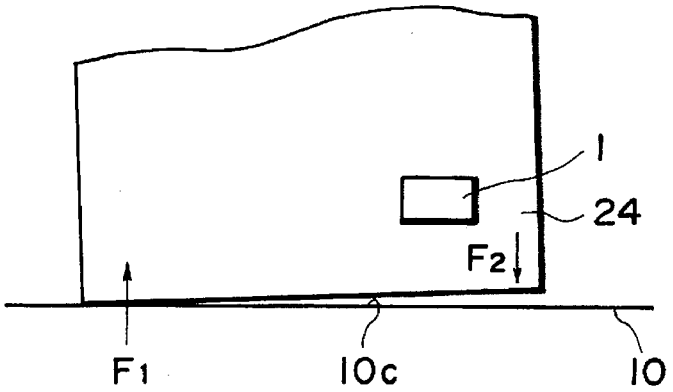
FIG. 8 is an explanatory view for explaining another example that the skew-feed of the sheet is corrected by an abutment surface of guide means.

By the way, the sheet 24 separated by the sheet supply roller 1 and the like is first fed along the lower guide portion 10. In this case, as shown in FIGS. 7 and 8, it is possible to correct the skew-feed of the sheet by abutting the sheet against an abutment surface 10*c* of the lower guide portion 10 or by sliding the sheet on the abutment surface. As shown in FIG. 7, if the right front corner (near to the sheet supply roller 1) of the sheet 24 goes ahead of the left front corner (remote from the sheet supply roller) of the sheet, the right front corner of the sheet is firstly abutted against the abutment surface of the lower guide portion 10, thus generating a resisting force $F_1$. As a result, since the sheet supply roller 1 is offset from the centerline of the sheet, a rotational force $F_2$ is generated around the sheet supply roller 1, thereby correcting the skew-feed of the sheet. As shown in FIG. 8, if the left front corner of the sheet goes ahead of the right front corner, the skew-feed of the sheet will be corrected in the same manner as the case of FIG. 7.

Figure 9:
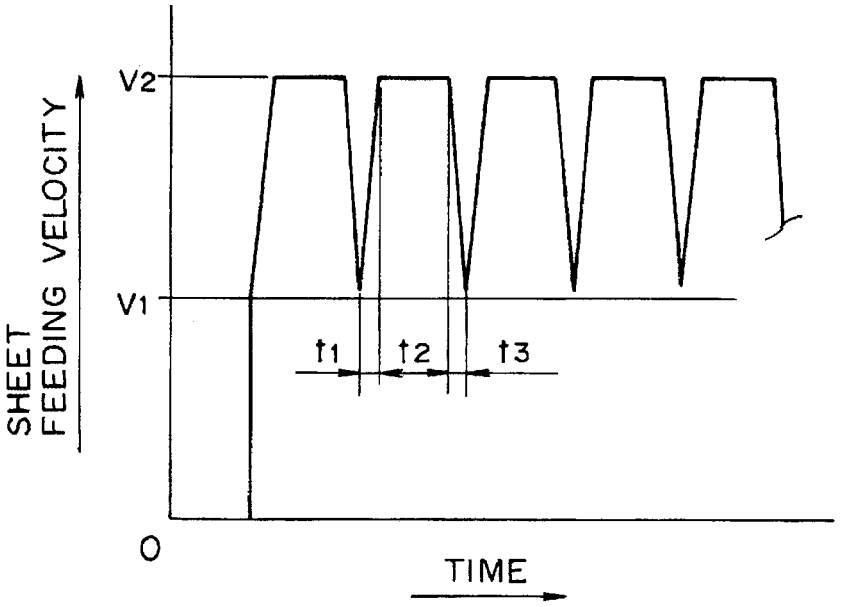
FIG. 9 is a graph showing a relation between a feeding speed and a time regarding the sheet supply roller of the automatic sheet feeding apparatus of FIG. 1.
Figure 10:
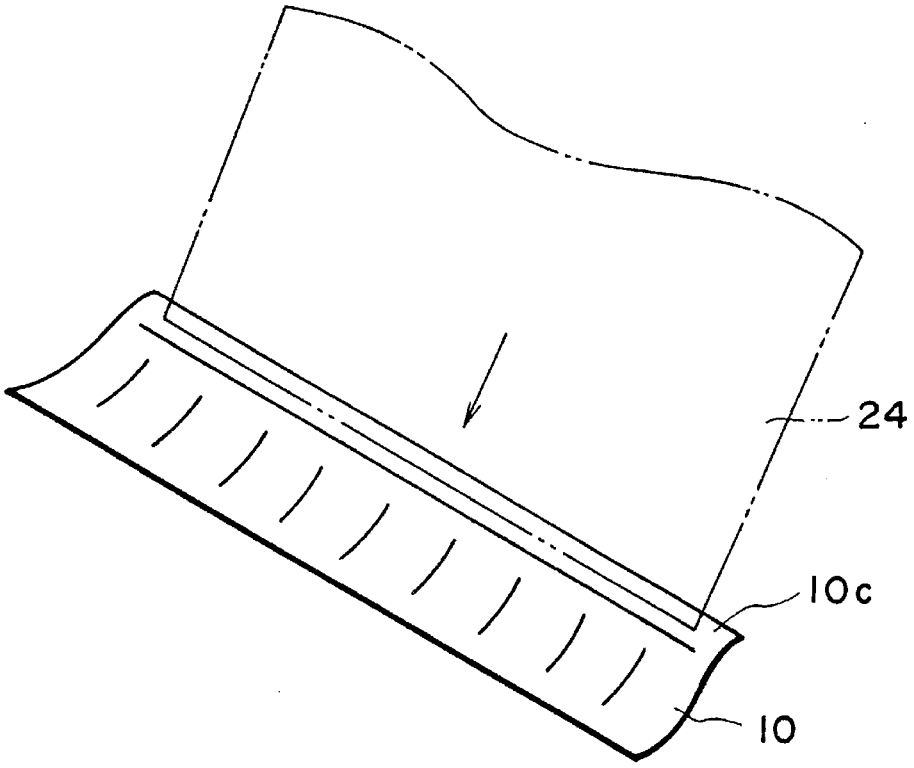
FIG. 10 is a perspective view showing an example that the skew-feed of the sheet is corrected by an abutment surface of guide means.

In any case, as shown in FIG. 9, by varying the drive (sheet feeding speed) of the sheet supply roller 1 periodically, the resisting force $F_1$ acts on the sheet with the shock, thus correcting the skew-feed of the sheet more effectively. In this case, it is so selected to have the following relations. That is, for example, $t_1=t_3=1\sim20$ msec, $t_2=100\sim1000$ msec, $v_1=10\sim100$ mm/sec, and $v_2=(1.5\sim3)\times v_1$. Incidentally, such drive control is performed by a control device C. In the illustrated embodiment, while the skew-feed of the sheet corrected by abutting the sheet against the abutment surface 10*c* of the lower guide portion 10 or by sliding the sheet on the abutment surface as shown in FIG. 10, the arrangement shown in FIG. 11 or the arrangement shown in FIG. 12 may be adopted to correct the skew-feed of the sheet more positively.

Figure 11:
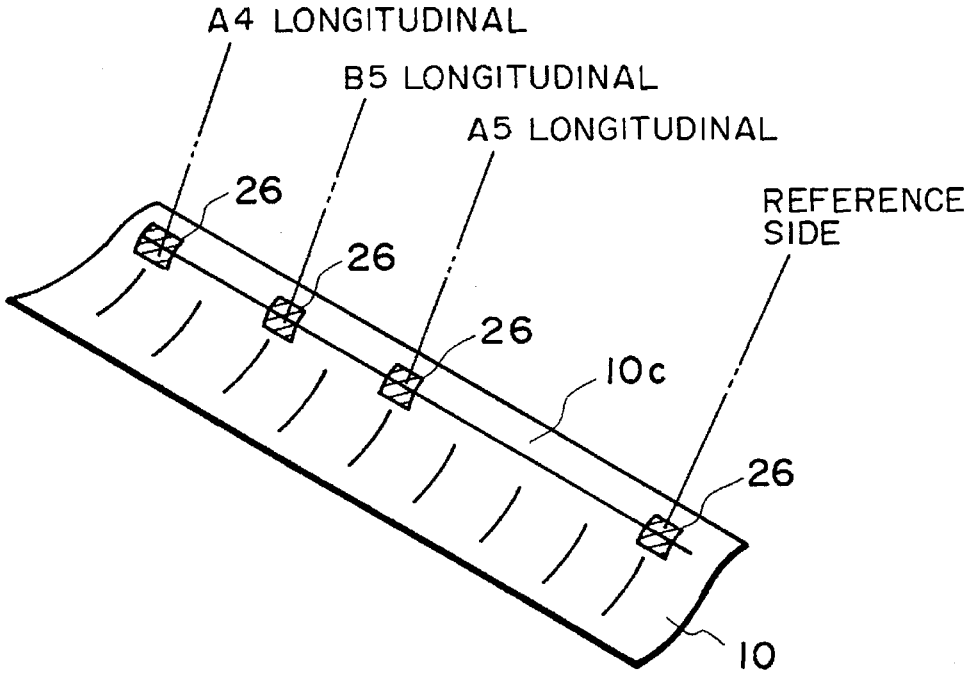
FIG. 11 is a perspective view showing an example that portions having higher coefficient of friction are attached to the abutment surface of the guide means as separate members.

In the arrangement shown in FIG. 11, resisting member or members 26 are provided on predetermined position or positions on the abutment surface 10*c* of the lower guide portion 10. Each resisting member 26 is made of rubber material such as natural rubber, butyl rubber or the like and has coefficient of friction of about 1~2. The lower guide portion 10 is made of resin material such as polystylene, ABS or the like having coefficient of friction of about 0.1~0.3. By providing such resisting members 26, it is possible to correct the skew-feed of the sheet more effectively.

Preferably, as shown in FIG. 11, a plurality of resisting members 26 are provided on the abutment surface of the lower guide portion to cope with various kinds of sheets (i.e., various sheet sizes).

Figure 12:
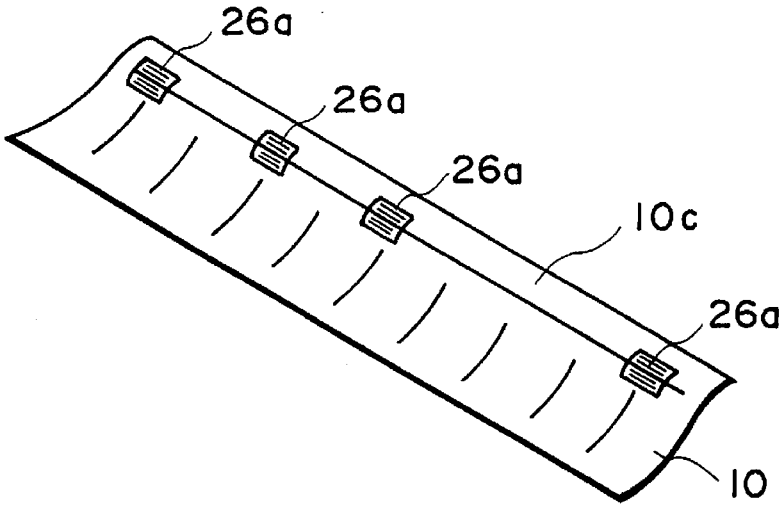
FIG. 12 is a perspective view showing an example that areas having higher coefficient of friction are integrally formed on the abutment surface of the guide means.
Figure 13:
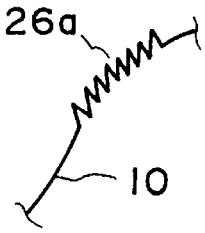
FIG. 13 is a sectional view of the area having a higher coefficient of friction.

In the embodiment shown in FIG. 12, by altering parts of the lower guide portions 10, apparent coefficients of friction of those parts are increased. More particularly, indentations 26*a* are formed on the abutment surface 10*c* of the lower guide portion 10 at several areas to provide the apparent coefficient of friction of about 1–2 at these areas, thus obtaining the same advantage as the rubber resisting member 26.

Figure 14:
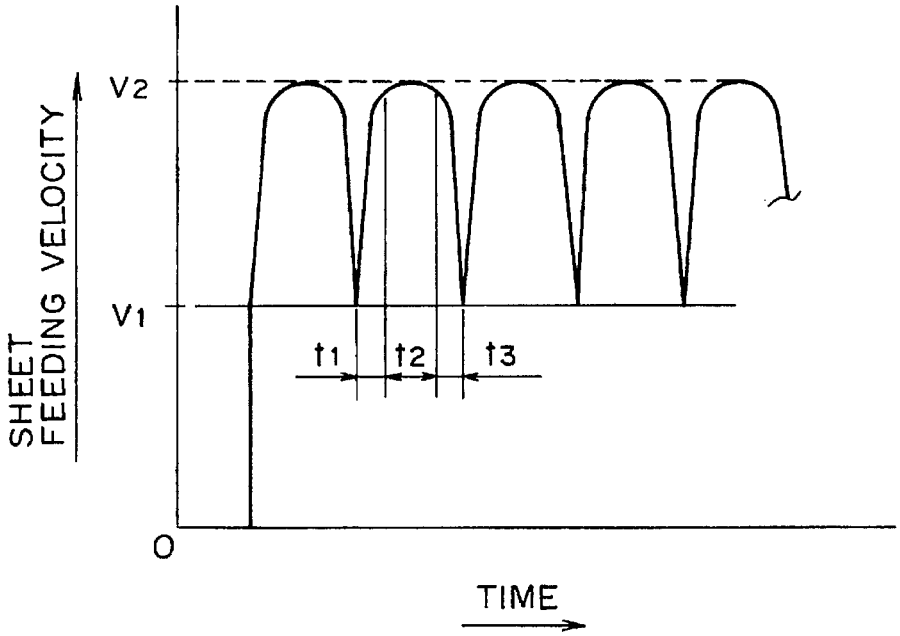
FIG. 14 is a graph showing another relation between a feeding speed and a time regarding the sheet supply roller of the automatic sheet feeding apparatus of FIG. 1.

With this arrangement, the resisting members 26*a* can be formed integrally with the lower guide portion 10, thus reducing the manufacturing cost. Further, in place of the speed pattern shown in FIG. 9, the drive control for the sheet supply roller 1 may be effected by utilizing the speed pattern of exponential function type as shown in FIG. 14. In this case, since the acceleration at the lower speed is great, it is possible to obtain the building-up feature passing through the resonance point and to smooth the acceleration at the high speed. Furthermore, it is possible to reduce the noise.

Figure 15:
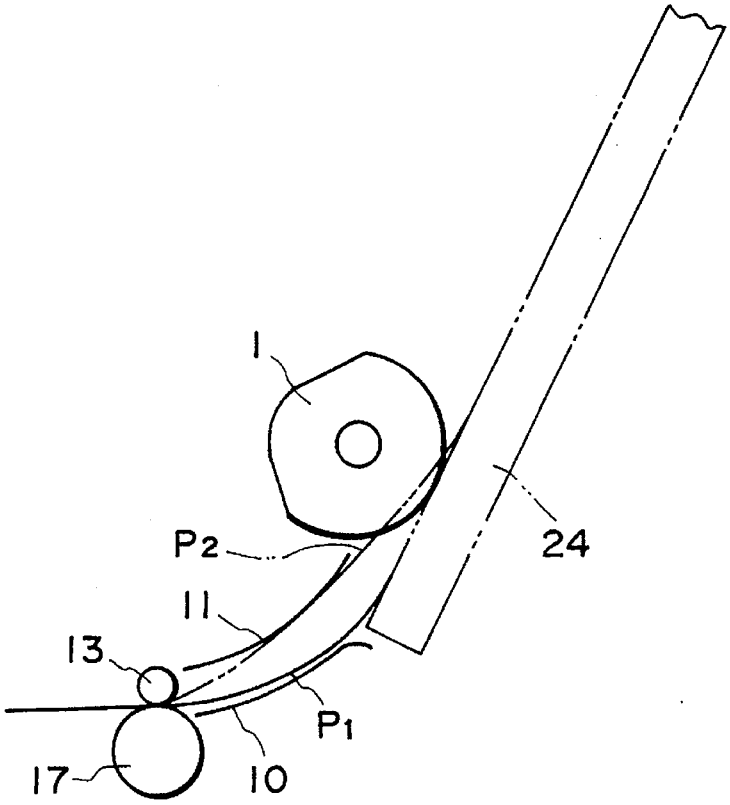
FIG. 15 is a schematic view of left and right sheet paths in the automatic sheet feeding apparatus of FIG. 1 when the sheet is not reformed by upper and lower guides.

The sheet 24 in which the skew-feed was corrected is passed between the upper guide 11 and the lower guide portion 10 to reach the nip between the pinch roller 13 and the feed roller 17 which are being rotated. In this case, since the sheet 24 is held-down only at one lateral side thereof by the sheet supply roller 1, as shown in FIG. 15, a sheet path (along which the sheet is advanced) for one lateral side (near the sheet supply roller 1) of the sheet differs from that for the other lateral side of the sheet, with the result that the sheet path $P_2$ of the sheet side (the other lateral side) goes ahead of the sheet path $P_1$ of the sheet side near the sheet supply roller, thus causing the skew-feed of the sheet. To avoid this, as shown in FIGS. 16 and 17, the configuration of the upper guide 11 is differentiated from that of the lower guide portion 10, thereby correcting the difference between the sheet paths $P_1$, $P_2$.

Figure 16:
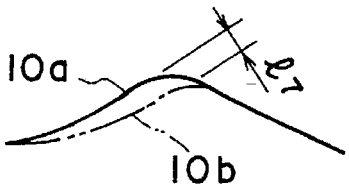
FIG. 16 is a schematic view showing a configuration of the lower guide of the automatic sheet feeding apparatus of FIG. 1.

More particularly, as shown in FIG. 16, the lower guide portion 10 is protruded toward the sheet path in such a manner that one side 10*a* of the lower guide portion near the sheet supply roller 1 (at which the sheet goes behind of the other side) protrudes toward the sheet path more than the other side 10*b*. The protruded amount may be continuously and gradually increased from the other side 10*b* to one side 10*a* to provide the maximum height difference $l_7$ of 1–5 mm (FIG. 16). Accordingly, at the side 10*a* of the lower guide portion near the sheet supply roller 1, since the lower guide portion acts to positively push the sheet 24 forwardly, the delay of the sheet feeding at the side near the sheet supply roller 1 is counter-balanced, thus correcting the skew-feed of the sheet. In this way, the skew-feed of the sheet due to the difference between the sheet paths can be corrected.

Figure 17:
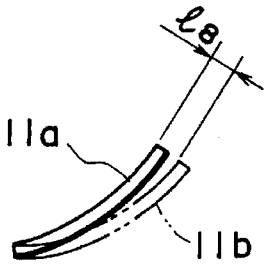
FIG. 17 is a schematic view showing a configuration of the upper guide of the automatic sheet feeding apparatus of FIG. 1.

On the other hand, in an example shown in FIG. 17, the upper guide 11 is protruded toward the sheet path in such a manner that one side 11*b* of the upper guide remote from the sheet supply roller 1 (at which the sheet goes ahead of the other side) protrudes toward the sheet path more than the other side 11*a*. The protruded amount may be continuously and gradually increased from the other side 11*a* to one side 11*b* to provide the maximum height difference $l_8$ of 1–20 mm (FIG. 17). Accordingly, at the other side 11*b* of the upper guide remote from the sheet supply roller 1, since the upper guide acts to positively push the sheet 24 rearwardly, the advance of the sheet feeding at the other side remote from the sheet supply roller 1 is counterbalanced, thus correcting the skew-feed of the sheet. In this way, the skew-feed of the sheet due to the difference between the sheet paths can be corrected.

Next, other examples of the lower guide portion 11 and the upper guide 10 will be explained.

Figure 18:
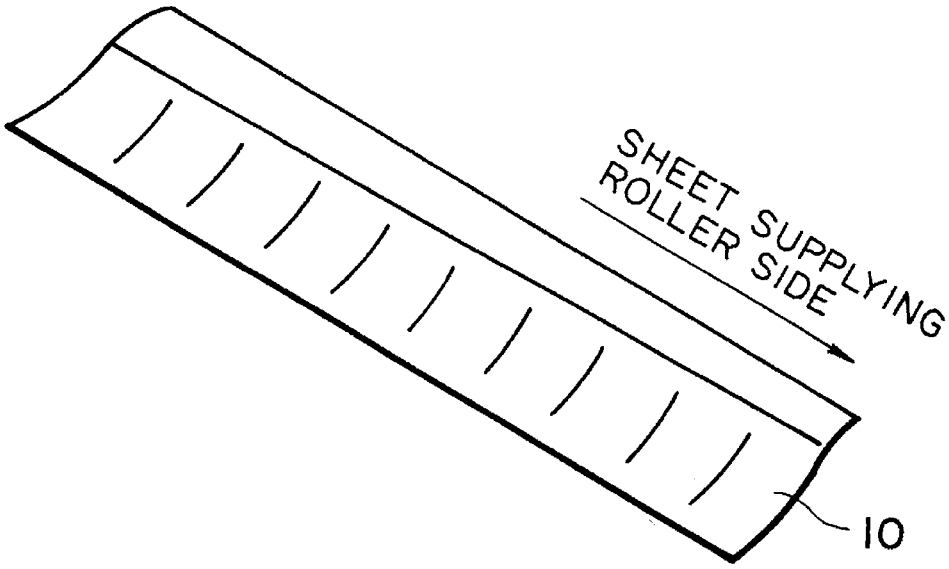
FIG. 18 is a perspective view of the lower guide of FIG. 16.
Figure 19:
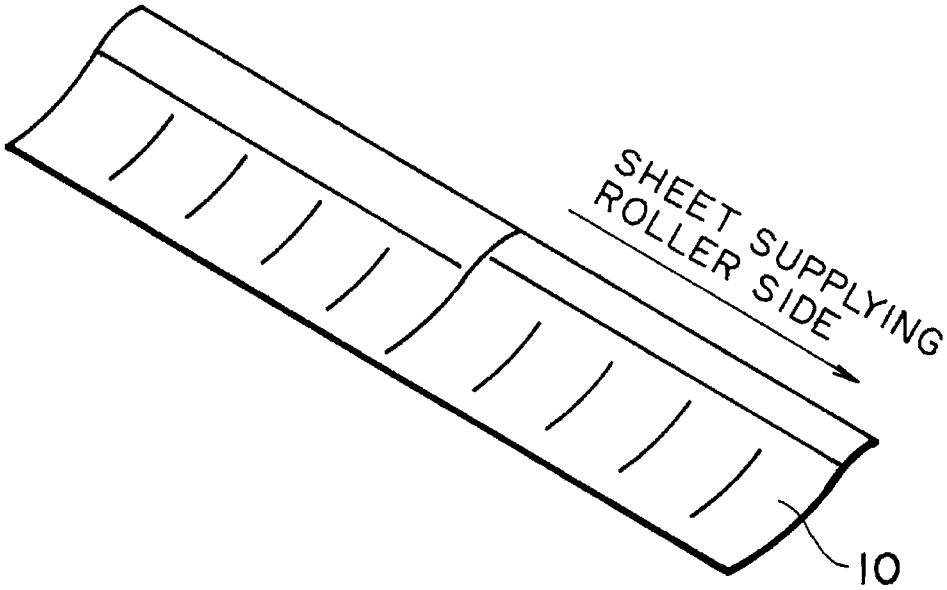
FIG. 19 is a perspective view of a lower guide according to another embodiment.

In the above-mentioned embodiment, while the lower guide portion 10 was protruded continuously and gradually from the other side 10*b* to one side 10*a* to provide the maximum height difference $l_7$ as shown in FIG. 18, the lower guide portion 10 may be protruded only at a position confronting to the sheet supply roller 1 and the other portion of the lower guide portion does not protrude, as shown in FIG. 19.

Figure 20:
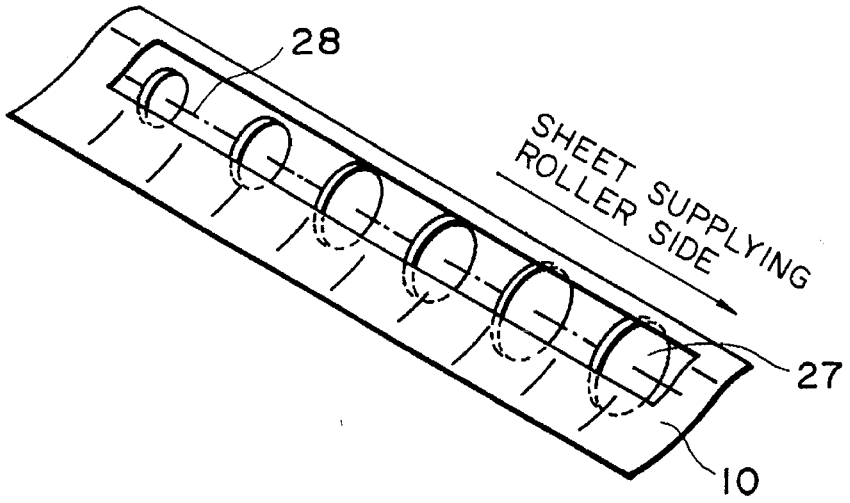
FIG. 20 is a perspective view of a lower guide according to a further embodiment.
Figure 22:
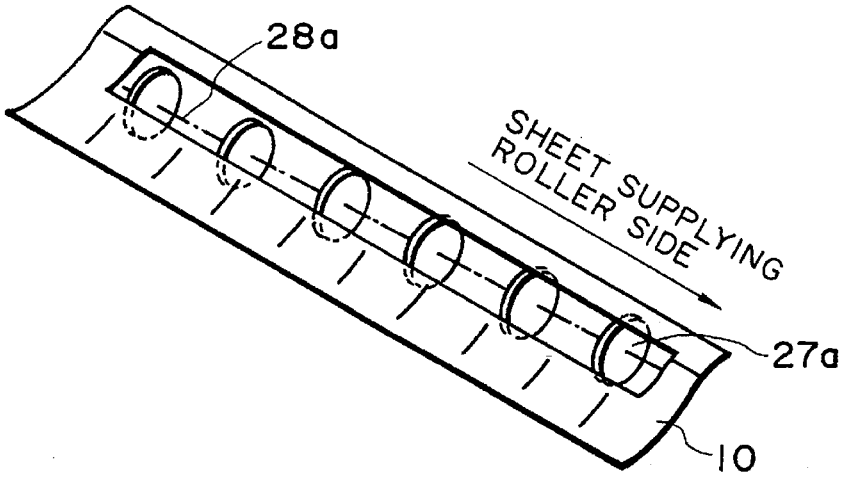
FIG. 22 is a perspective view of a lower guide according to a still further embodiment.

Alternatively, as shown in FIGS. 20 and 22, lower guide rollers 27 may be provided.

Figure 21:
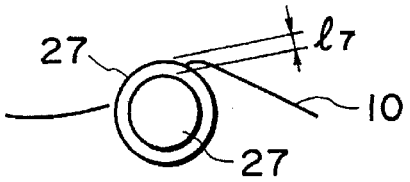
FIG. 21 is a schematic view showing the alignment of rollers of FIG. 20.

In an example shown in FIGS. 20 and 21, the lower guide rollers 27 are arranged so that diameters of the rollers are gradually increased by about 5–10 mm more than the adjacent roller toward the sheet supply roller side. Accordingly, since the guide roller 27 nearest to the sheet supply roller is protruded toward the sheet path at the maximum extent, the difference between the sheet paths can be compensated. Further, since the lower guide rollers 27 can be rotated around a common rotational axis 28, the friction between the sheet and the rollers when the former is slidingly moved on the latter is reduced, thus providing the more smooth sheet supply.

Figure 23:
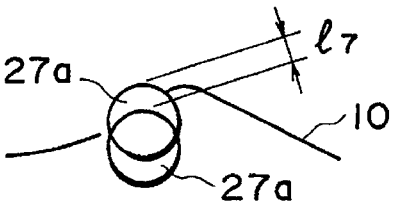
FIG. 23 is a schematic view showing the alignment of rollers of FIG. 22.

In the above example, while the diameters of the lower guide rollers were gradually increased, lower guide rollers 27*a* having the same diameter may be used as shown in FIGS. 22 and 23. In this case, as mentioned above, the lower guide rollers 27*a* have the same diameter, but a common rotational axis 28*a* to which the rollers are attached is inclined upwardly toward the sheet supply roller side, unlike the example of FIGS. 20 and 21. Accordingly, since the lower guide roller 27*a* nearest to the sheet supply roller is protruded toward the sheet path at the maximum extent, the difference between the sheet paths can be compensated. Further, since the identical guide rollers can be used, the kinds of parts can be reduced.

Figure 24:
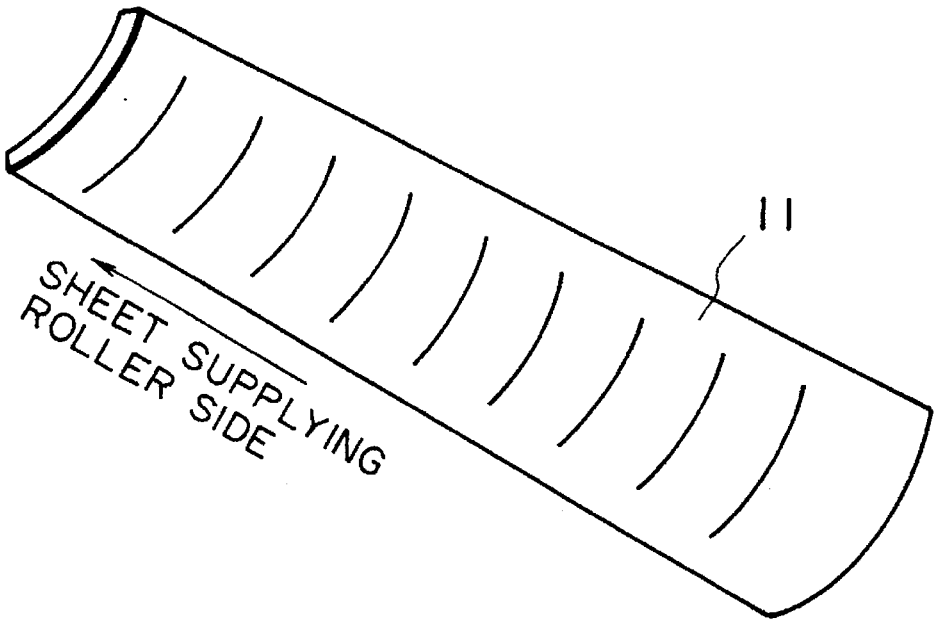
FIG. 24 is a perspective view of the upper guide of FIG. 17.
Figure 25:
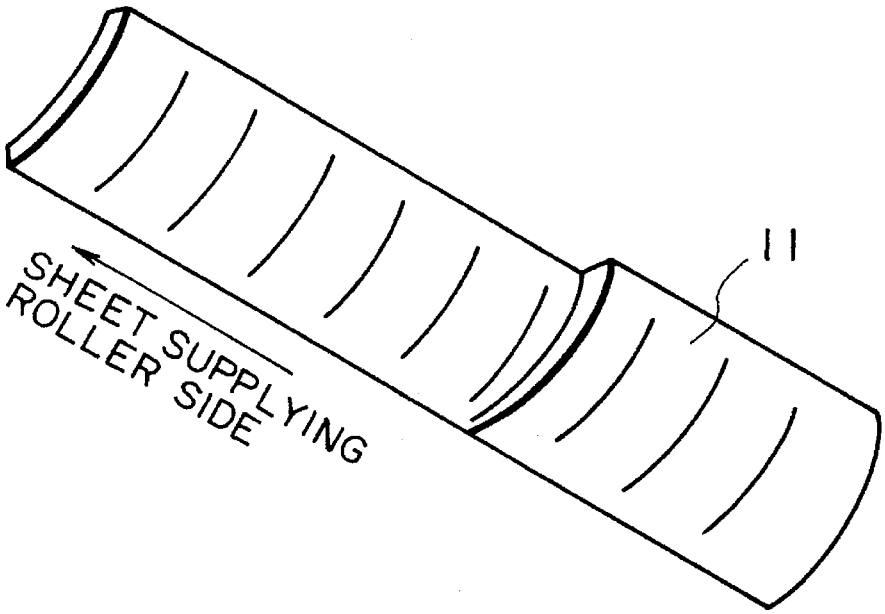
FIG. 25 is a perspective view of a lower guide according to another embodiment.

Also regarding the upper guide 11, as mentioned above, while the upper guide 11 was protruded continuously and gradually from the one side 11*a* to the other side 11*b* to provide the maximum height difference $l_8$ as shown in FIG. 24, the upper guide 11 may be protruded only at a position confronting to the sheet supply roller 1 and the other portion of the upper guide does not protrude, as shown in FIG. 25.

Figure 26:
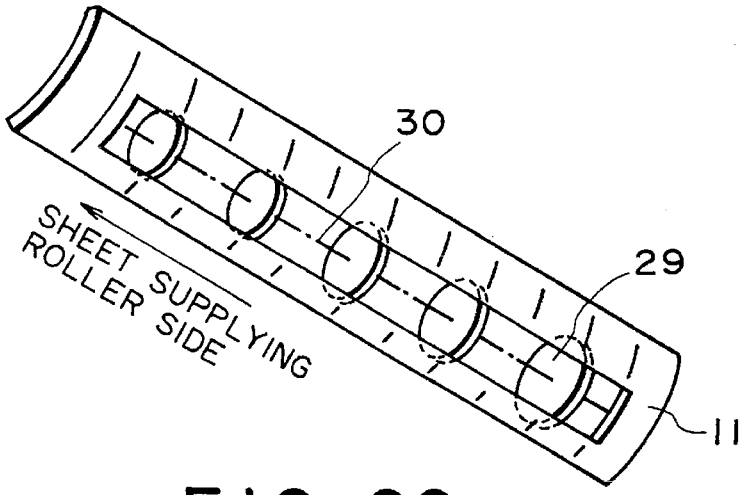
FIG. 26 is a perspective view of a lower guide according to a further embodiment.
Figure 28:
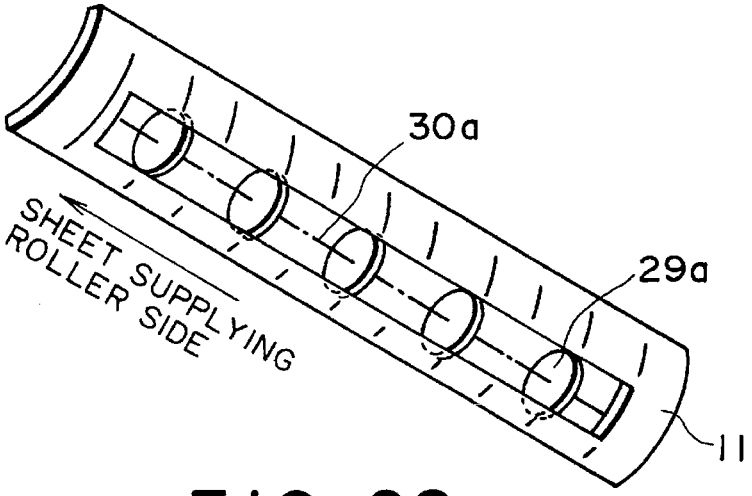
FIG. 28 is a perspective view of a lower guide according to a still further embodiment.

Alternatively, as shown in FIGS. 26 and 28, upper guide rollers 29 may be provided.

Figure 27:
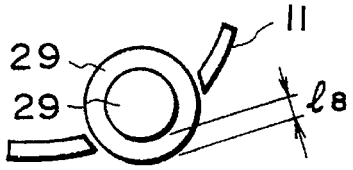
FIG. 27 is a schematic view showing the alignment of rollers of FIG. 26.

In an example shown in FIGS. 26 and 27, the upper guide rollers 29 are arranged so that diameters of the rollers are gradually decreased by about 5–10 mm more than the adjacent roller toward the sheet supply roller side. Accordingly, since the guide roller 29 farthest to the sheet supply roller is protruded toward the sheet path at the maximum extent, the difference between the sheet paths can be compensated. Further, since the lower guide rollers 29 can be rotated around a common rotational axis 30, the friction between the sheet and the rollers when the former is slidingly moved on the latter is reduced, thus providing smoother sheet supply.

Figure 29:
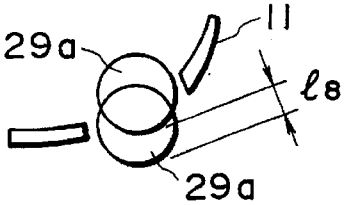
FIG. 29 is a schematic view showing the alignment of rollers of FIG. 28.

In the above example, while the diameters of the upper guide rollers were gradually increased, upper guide rollers 29*a* having the same diameter may be used as shown in FIGS. 28 and 29. In this case, as mentioned above, the upper guide rollers 29*a* have the same diameter, but a common rotational axis 30*a* to which the rollers are attached is inclined downwardly toward the sheet supply roller side, unlike the example of FIGS. 26 and 27. Accordingly, since the upper guide roller 29*a* farthest to the sheet supply roller is protruded toward the sheet path at the maximum extent, the difference between the sheet paths can be compensated. Further, since the identical guide rollers can be used, the kinds of parts can be reduced.

Incidentally, the above-mentioned lower guide portions 12 and the upper guides 10 may be appropriately combined.

Figure 30:
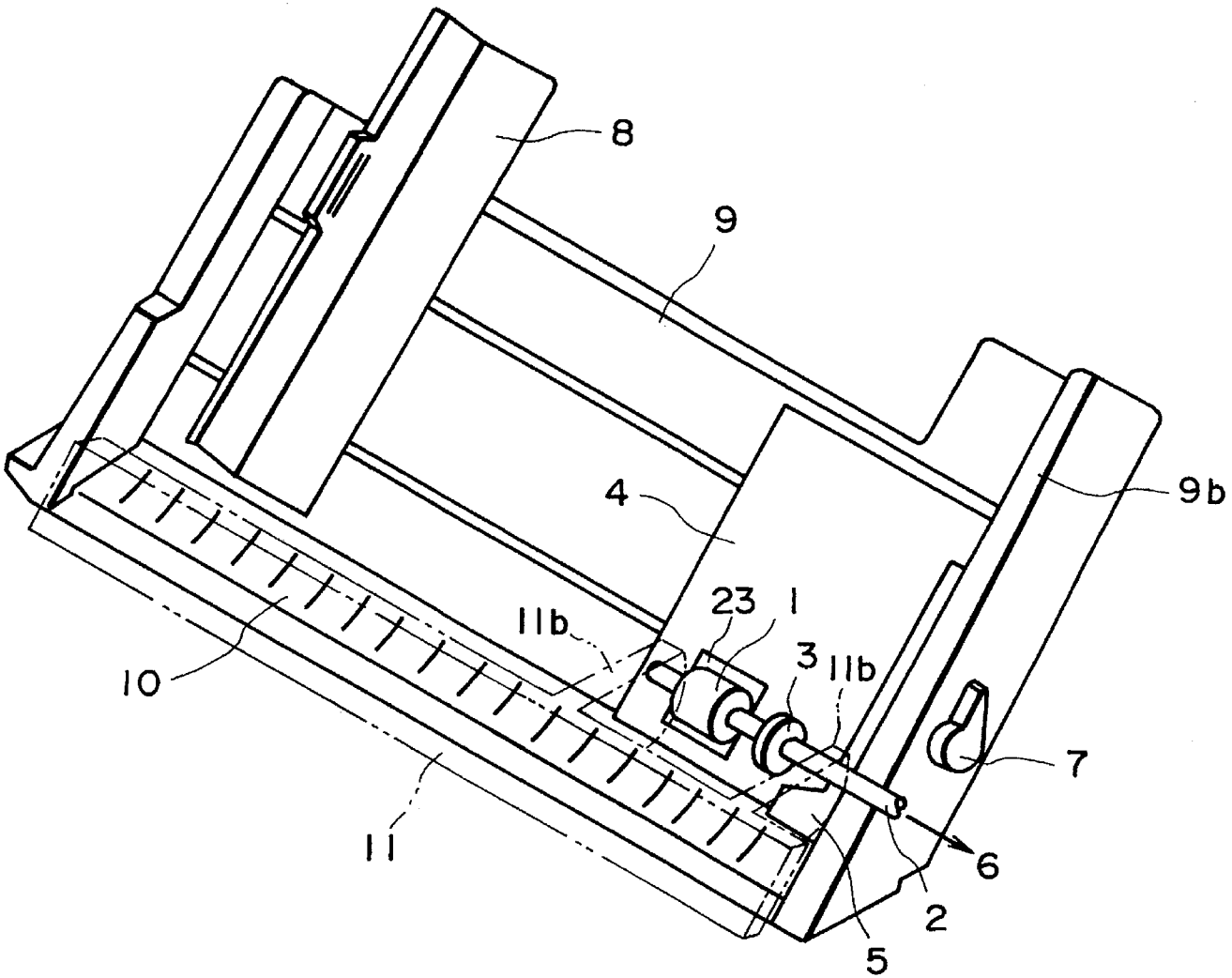
FIG. 30 a perspective view of the entire automatic sheet feeding apparatus having a sheet supply roller shaft supporting means according to another embodiment.
Figure 31:
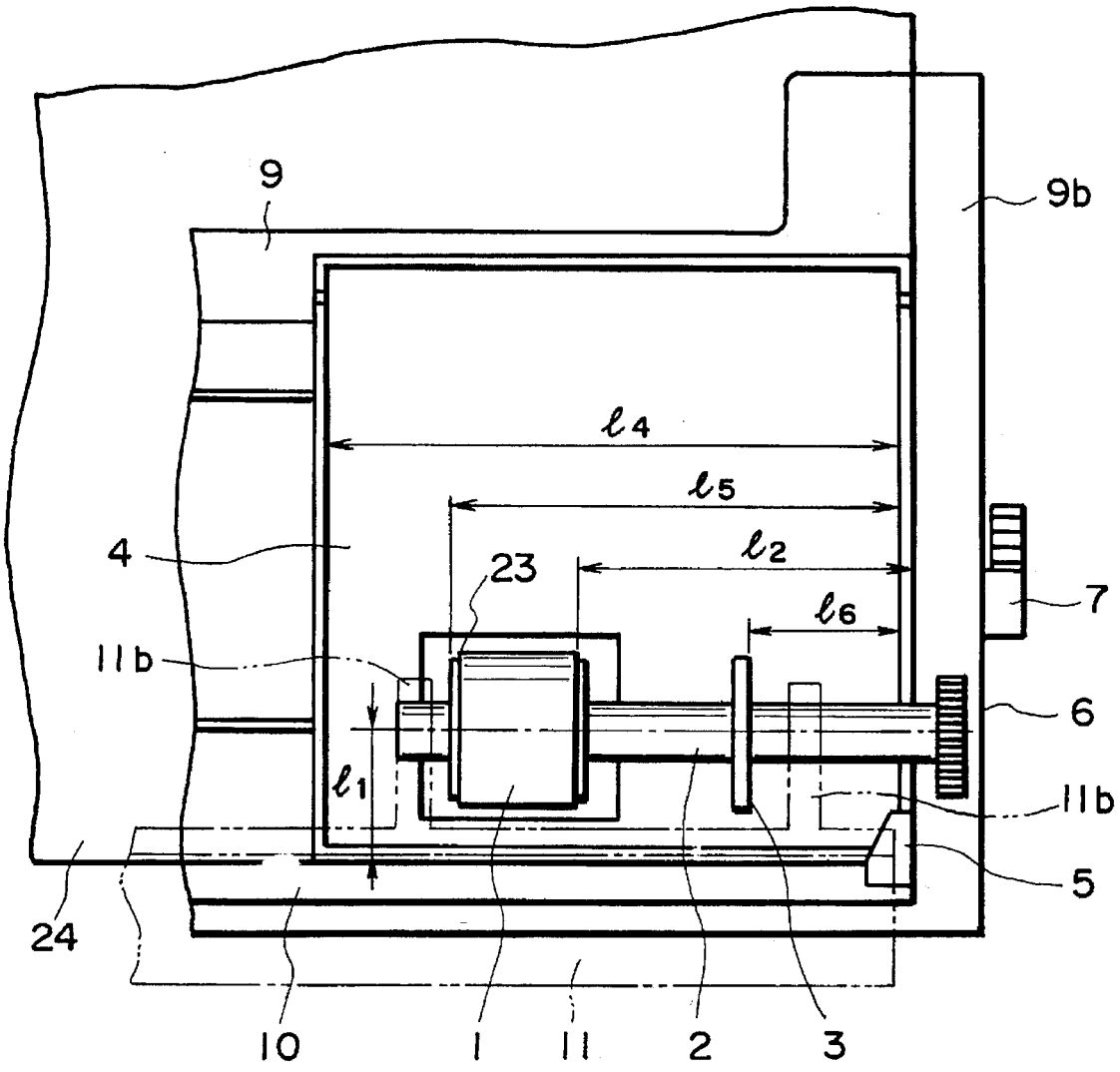
FIG. 31 is a plan view of the apparatus of FIG. 30.

In an embodiment shown in FIGS. 30 and 31, the sheet supply roller shaft 2 has an extension extending from the sheet supply roller 1 toward inside, and the sheet supply roller shaft is rotatably supported by supporting portions 11*b* integrally formed with the upper guide 11 at two points, i.e., the shaft extension and a shaft portion between the auxiliary roller 3 and the drive gear 6.

Figure 32:
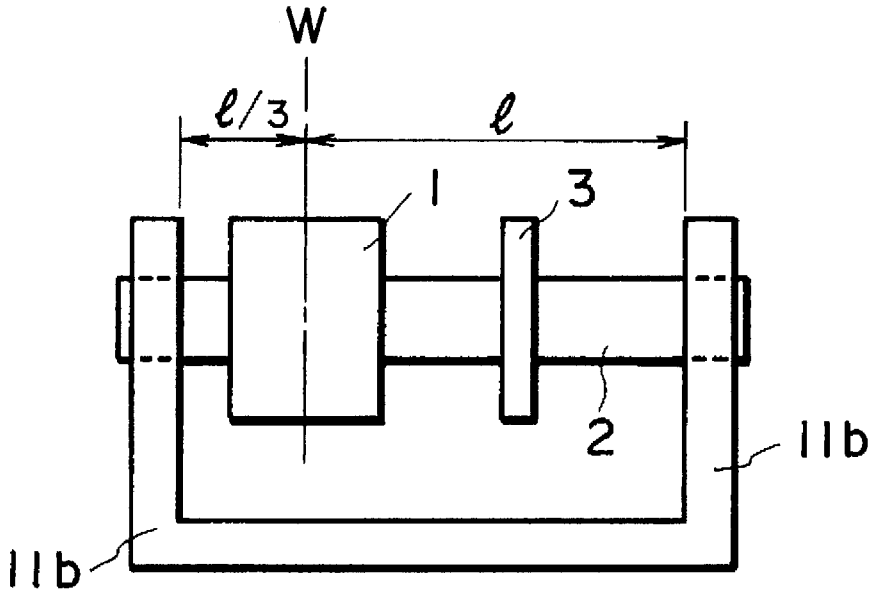
FIG. 32 is a plan view of the supporting means of FIG. 30.
Figure 33:
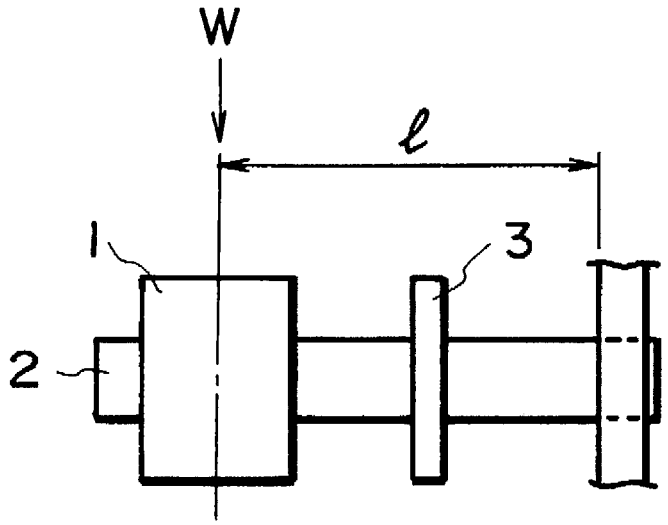
FIG. 33 is a plan view of a sheet supply roller shaft supporting means of FIG. 1.

Since the sheet supply roller 1 is spaced apart from the fixed side guide 9*b*, it is feared that the sheet roller cannot be stably supported by a cantilevered fashion as shown in FIG. 33. In comparison with the cantilever fashion shown in FIG. 33 and the both-end supported fashion shown in FIGS. 30 to 32, the deflections δ at the central portion of the sheet supply roller 1 will be as follows:

(A) Cantilever fashion $\delta=WI^3/3EI$; and (B) Both-end supported fashion $\delta=WI^3/128EI$, where, E is Young's modulus and I is geometrical moment of inertia.

As apparent from the above, in the case of the both-end supported fashion, the remarkably stable supporting ability can be obtained in comparison with the cantilever fashion. Accordingly, the urging force W of the pressure plate 4 can be made greater, and the freedom of selection of the configuration and/or material of the sheet supply roller can be increased.

Figure 34:
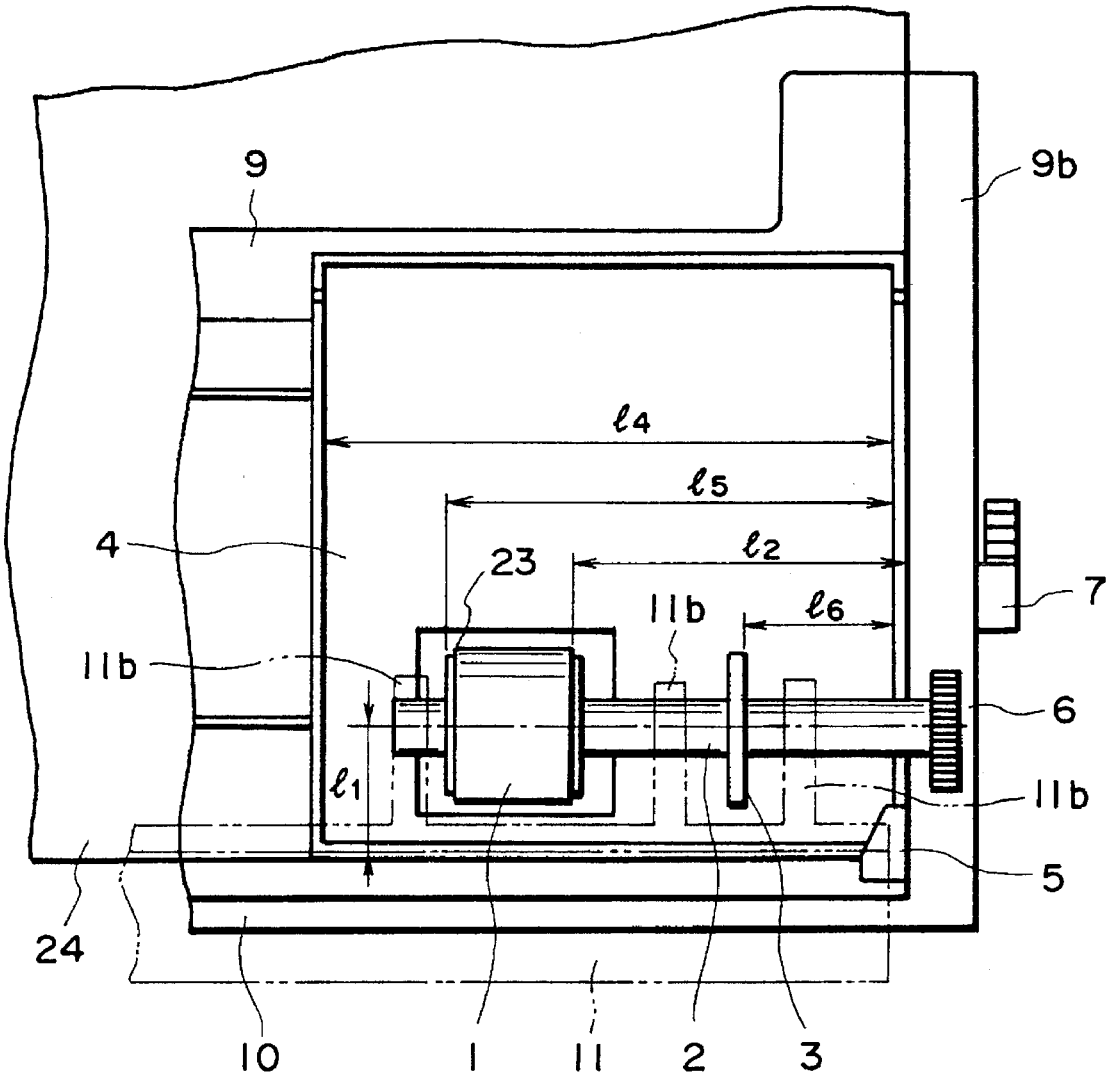
FIG. 34 is a plan view showing a sheet supply roller shaft supporting means according to a further embodiment.

In the embodiment shown in FIG. 30, while two supporting portions 11*b* were integrally formed with the upper guide 11 for supporting the shaft extension and the shaft portion between the auxiliary roller 3 and the drive gear 6, respectively, an additional supporting portion 11*b* may be provided for supporting a shaft portion between the sheet supply roller 1 and the auxiliary roller 3 as shown in FIG. 34, thereby supporting the sheet supply roller shaft at three points. In this case, it is possible to suppress the displacement of the sheet supply roller 1.

Figure 35:
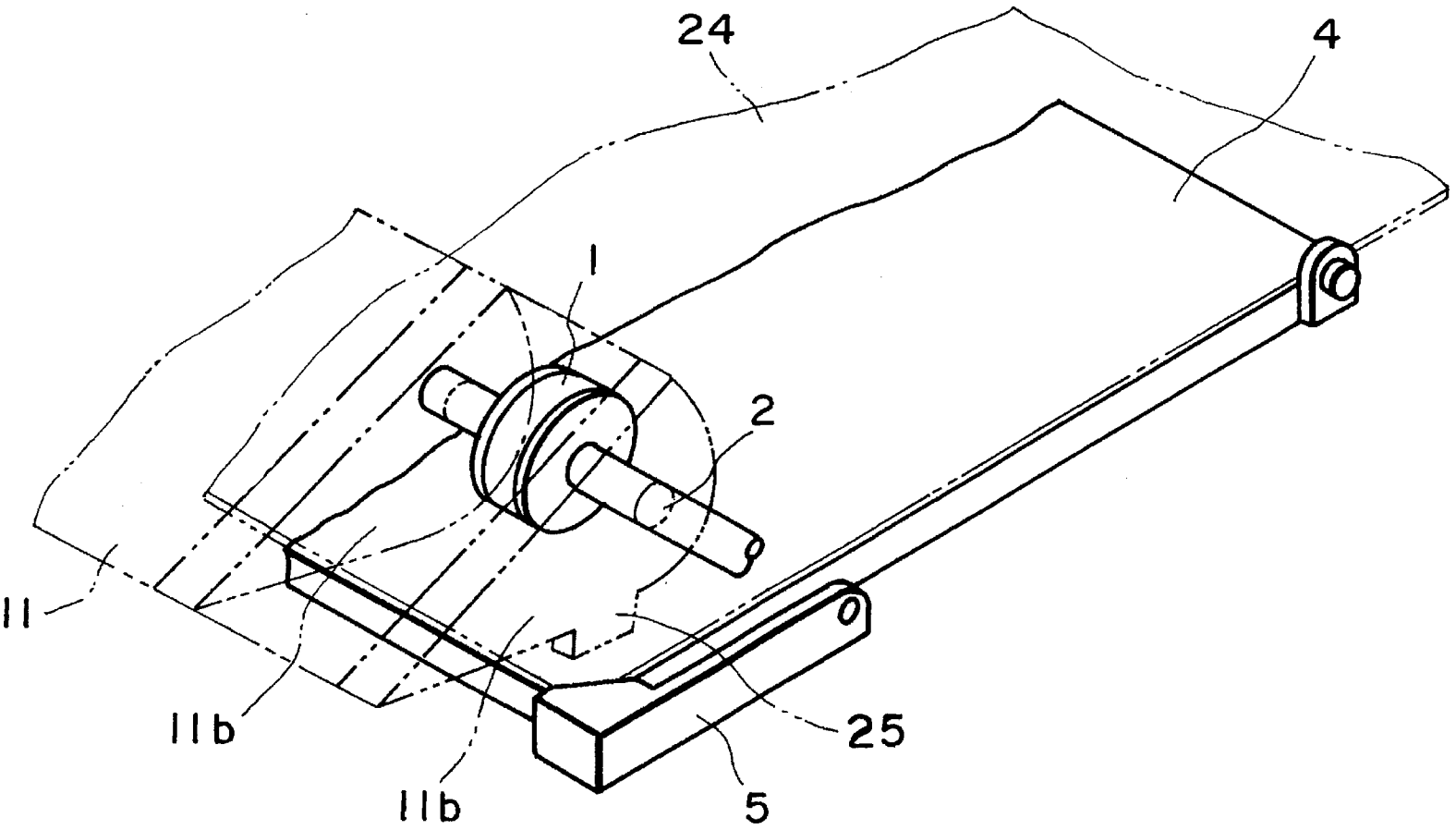
FIG. 35 is a perspective view showing a sheet supply roller shaft supporting means according to a still further embodiment.
Figure 36:
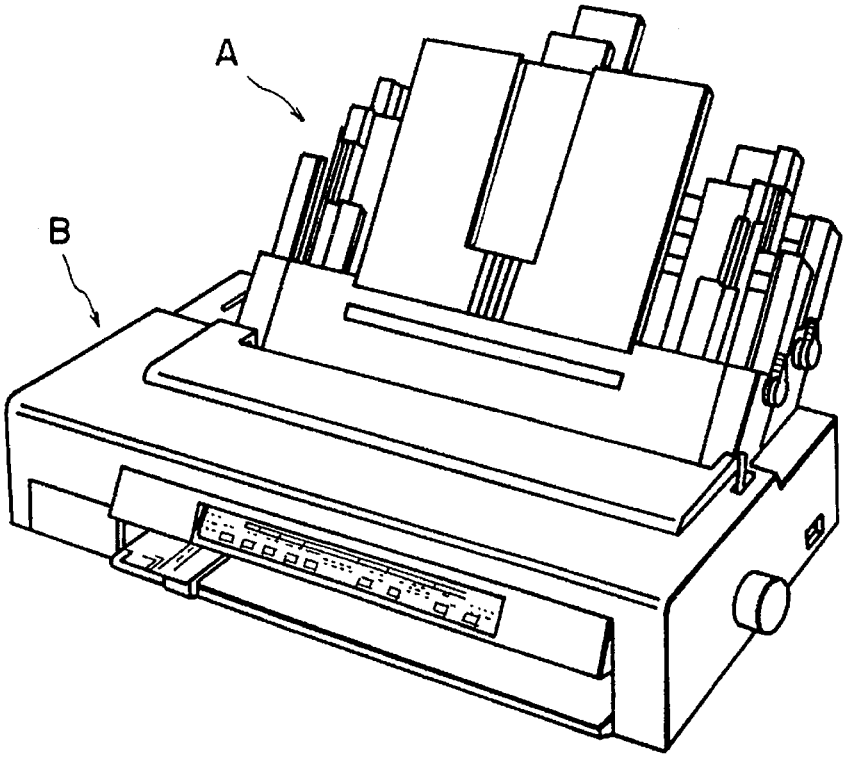
FIG. 36 PRIOR ART
FIG. 36 is a perspective view of a conventional recording system.
Figure 37:
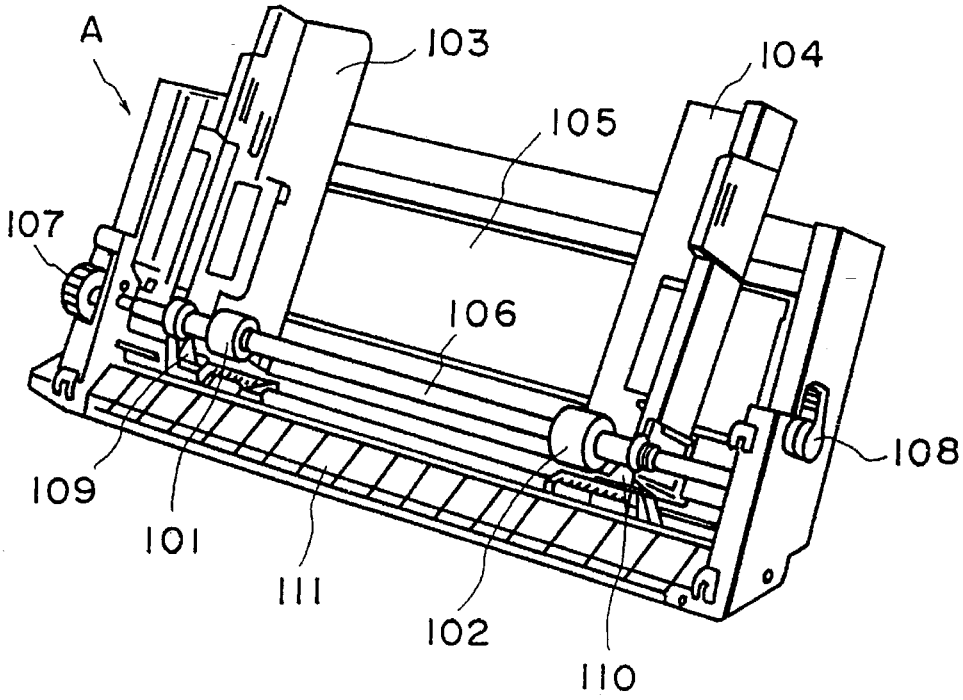
FIG. 37 PRIOR ART
FIG. 37 is a perspective view of a conventional automatic sheet feeding apparatus.

In the embodiment shown in FIG. 31, while the sheet 24 was held down by the auxiliary roller 3 provided on the sheet supply roller shaft 2, in place of the auxiliary roller 3, a sheet hold-down means 26 may be formed on the supporting portion 11*b* as shown in FIG. 35. In this case, the construction of the sheet supply roller mechanism can be more simplified, and it is possible to provide the smooth sheet supply since the sheet hold-down means 26 is integrally formed with the guide means for the sheet 24.

With the arrangements as mentioned above, it is possible to feed the sheet 24 with high accuracy and without occurring the skew-feed of the sheet, by the single sheet supply roller 1 and the single separating claw 5. Thus, the apparatus can be more simplified in comparison with the conventional ones, and the number of parts or elements can also be reduced. Further, since the sheet supply roller shaft 2 is supported only at one side and does not extend toward the other side (toward the movable side guide 8), the installation space for the sheet supply roller shaft can be saved, and such vacant space can be effectively utilized to mount other elements (for example, electroic substrate and the like) therein.

Incidentally, in the illustrated embodiments, while an example that the automatic sheet feeding apparatus is mounted on the recording system of ink jet type was explained, the automatic sheet feeding apparatus may be used with recording systems (printers, copying machines, facsimiles and the like) of wire dot type, thermal type and electrophotographic type. Further, the sheet stacking means may be a sheet supply deck, as well as the sheet supply cassette. In addition, the automatic sheet feeding apparatus may be formed integrally with the recording system.

As mentioned above, according to the present invention, since the skew-feed correction means is provided on the guide means, it is possible to feed the sheet with high accuracy while correcting the skew-feed of the sheet, only by the single sheet supply means and the single separation means. Thus, the construction of the apparatus can be simplified and the number of parts can be reduced, thereby making the automatic sheet feeding apparatus inexpensive, small-sized and light-weighted. Further, the recording system having such automatic sheet feeding apparatus can also be made inexpensive and small-sized.

We claim:

1. An automatic sheet feeding apparatus comprising:

sheet supporting means for supporting sheets thereon, having a first position on a first side of a centerline of said sheet supporting means in a sheet feeding direction and a second position on a second side of the centerline opposite to the first side;

a sheet supply member disposed at the first position on the first side of the centerline of said sheet supporting means, for feeding out the sheets from said sheet supporting means in a sheet feeding direction;

a separating claw for separating the sheets fed by said sheet supply member one by one by regulating one front corner on the first side of the sheets; and skew-feed correction means disposed downstream of said sheet supply member for correcting a skew-feed of the sheets caused by disposition of said sheet supply member and said separating claw on the first side of the centerline, by applying a resisting force to a leading end of the sheets fed by said sheet supply member, wherein a sheet supply member and a separating claw are positioned only on the first side and the second side is without a sheet supply member and separating claw.

2. An automatic sheet feeding apparatus according to claim 1, wherein said skew-feed correction means comprises an abutment surface against which the leading end of the sheet is abutted and by which the resisting force is applied to the sheet.

3. An automatic sheet feeding apparatus according to claim 2, wherein said abutment surface has a curved surface with which the sheets are slidingly contacted and by which the resisting force is applied to the sheets.

4. An automatic sheet feeding apparatus according to claim 3, wherein areas having a high coefficient of friction are provided on said abutment surface.

5. An automatic sheet feeding apparatus according to claim 4, wherein said areas having a high coefficient of friction are obtained by rubber members attached to said abutment surface at positions corresponding to sizes of the sheets, thereby applying a partially increased resisting force to the sheet.

6. An automatic sheet feeding apparatus according to claim 4, wherein said areas having a high coefficient of friction are obtained by indentations formed on said abutment surface at positions corresponding to sizes of the sheets, thereby applying a partially increased resisting force to the sheet.

7. An automatic sheet feeding apparatus according to claim 2, wherein each sheet is abutted against said abutment surface while varying a sheet feeding speed of said sheet supply member.

8. An automatic sheet feeding apparatus according to claim 2, wherein areas having a high coefficient of friction are provided on said abutment surface.

9. An automatic sheet feeding apparatus according to claim 8, wherein said areas having a high coefficient of friction are obtained by rubber members attached to said abutment surface at positions corresponding to sizes of the sheets, thereby applying a partially increased resisting force to the sheet.

10. An automatic sheet feeding apparatus according to claim 8, wherein said areas having a high coefficient of friction are obtained by indentations formed on said abutment surface at positions corresponding to sizes of the sheets, thereby applying a partially increased resisting force to the sheet.

11. An automatic sheet feeding apparatus according to claim 1, further comprising a a separating claw for regulating the front edge of the sheets, and the sheets are separated one by one by riding over said separating claw.

12. An automatic sheet feeding apparatus according claim 1, further comprising regulating means for suppressing a flexion of the sheets generated when the sheets ride over said separating claw.

13. An automatic sheet feeding apparatus according to claim 12, wherein said sheet supply member comprises a sheet supply roller, and said regulating means comprises an auxiliary roller provided on a drive shaft of said sheet supply roller.

14. An automatic sheet feeding apparatus according to claim 12, wherein said regulating means comprises a sheet hold-down portion integrally formed with a supporting portion for supporting said drive shaft of said sheet supply roller.

15. An automatic sheet feeding apparatus comprising:

sheet supporting means for supporting sheets thereon, having a first position on a first side of a centerline of said sheet supporting means in a sheet feeding direction and a second position on a second side of the centerline opposite to the first side;

a sheet supply member disposed at the first position on the first side of the centerline of said sheet supporting means, for feeding out the sheets from said sheet supporting means in a sheet feeding direction;

a separation member for separating the sheets fed out by said sheet supply member one by one, by regulating one front corner on the first side of the sheets; and guide means disposed downstream of said sheet supply member for correcting a skew-feed of the sheets caused by arrangement of said sheet supply member and said separation member on the first side of the centerline, by correcting a deformation of the sheet in a thickness direction thereof generated at the second side to of said sheet supply member and said separation member in a sheet widthwise direction, wherein a sheet supply member and a separating claw are positioned only on the first side and the second side is without a sheet supply member and separating claw.

16. An automatic sheet feeding apparatus according to claim 15, wherein said guide means comprises an upper guide member and a lower guide member, and a portion of said lower guide member near said separation member in a widthwise direction of the sheet is partially protruded toward said upper guide member to suppress a flexion of the sheets generated near said separation member.

17. An automatic sheet feeding apparatus according to claim 15, wherein said guide means comprises an upper guide member and a lower guide member, and said upper guide member has a plurality of rollers, and the roller farthest from said separation member in a widthwise direction of the sheet is protruded toward said lower guide member to suppress a flexion of the sheets generated remote from said separation member.

18. An automatic sheet feeding apparatus according to claim 15, wherein said guide means comprises an upper guide member and a lower guide member, and said lower guide member has a plurality of rollers, and the roller nearest to said separation member in a widthwise direction of the sheet is protruded toward said upper guide member to suppress a flexion of the sheets generated near said separation member.

19. An automatic sheet feeding apparatus according to claim 15, wherein said separation member comprises a separating claw for regulating the front edge of the sheets, and the sheets are separated one by one by riding over said separating claw.

20. An automatic sheet feeding apparatus according to claim 19, further comprising regulating means for suppressing a flexion of the sheets generated when the sheets ride over said separating claw.

21. An automatic sheet feeding apparatus according to claim 15, wherein said guide means comprises an upper guide member and a lower guide member, and a portion of said upper guide member remote from said separation member in a widthwise direction of the sheet is partially protruded toward said lower guide member to suppress a flexion of the sheets generated remote from said separation member.

22. An image forming system comprising:

sheet supporting means for supporting sheets thereon, having a first position on a first side of a centerline of said sheet supporting means in a sheet feeding direction and a second position on a second side of the centerline opposite to the first side;

a sheet supply member disposed at the first position on the first side of the centerline of said sheet supporting means, for feeding out the sheets from said sheet supporting means in a sheet feeding direction;

a separating claw for separating the sheets fed by said sheet supply member one by one by regulating one front corner on the first side of the sheets;

skew-feed correction means disposed downstream of said sheet supply member for correcting a skew-feed of the sheets caused by disposition of said sheet supply member and said separating claw on the first side of the centerline, by applying a resisting force to a leading end of the sheets fed by said sheet supply member, wherein a sheet supply member and a separating claw are positioned only on the first side and the second side is without a sheet supply member and separating claw; and image forming means for forming an image on the sheet fed and skew-feed corrected by said skew-feed correction means.

23. An image forming system according to claim 22, wherein said image forming means is an ink jet type in which the image is formed by discharging ink by a change in pressure caused by growth and contraction of a bubble or bubbles due to nucleate boiling generated by thermal energy.

24. An image forming system comprising:

sheet supporting means for supporting sheets thereon, having a first position on a first side of a centerline of said sheet supporting means in a sheet feeding direction and a second position on a second side of the centerline opposite to the first side;

a sheet supply member disposed at the first position on the first side of the centerline of said sheet supporting means, for feeding out the sheets from said sheet supporting means in a sheet feeding direction;

a separation member for separating the sheets fed out by said sheet supply member one by one, by regulating one front corner on the first side of the sheets;

guide means disposed downstream of said sheet supply member for correcting a skew-feed of the sheets caused by arrangement of said sheet supply member and said separation member on the first side of the centerline by correcting a deformation of the sheet in a thickness direction thereof generated at the second side of the centerline of said sheet supply member and said separation member in a sheet widthwise direction, wherein a sheet supply member and a separating claw are positioned only on the first side and the second side is without a sheet supply member and separating claw; and image forming means for forming an image on the sheet fed and skew-feed corrected by said guide means.

25. An image forming system according to claim 24, wherein said image forming means is an ink jet type in which the image is formed by discharging ink by the change in pressure caused by growth and contraction of a bubble due to nucleate boiling generated by thermal energy.

* * * * *

UNITED STATES PATENT AND TRADEMARK OFFICE

CERTIFICATE OF CORRECTION

PATENT NO. : 5,648,808
DATED : July 15, 1997
INVENTOR(S) : Haruyuki YANAGI, et al.

It is certified that error appears in the above-identified patent and that said Letters Patent is hereby corrected as shown below:

Title Page, [56], delete "Yamagawa" and insert therefor --Yanagawa--.

Title Page, [57], Abstract, delete "supporting means" and insert therefor --supporter--.

Column 12, line 2, delete "a", first occurrence; and
Line 5, after "according", insert --to--.

Column 14, line 37, delete "the", second occurrence, and insert therefor --a--.

Signed and Sealed this
Seventeenth Day of February, 1998

*Attest:*

*Attesting Officer*

Bruce Lehman

BRUCE LEHMAN

*Commissioner of Patents and Trademarks*